United States Patent [19]

Gemma

[11] Patent Number: 4,984,598

[45] Date of Patent: Jan. 15, 1991

[54] SYSTEM FOR WORKING ON THE PRIMARY PIPEWORK AND WATER BOX OF A NUCLEAR POWER STATION STEAM GENERATOR

[75] Inventor: Antoine Gemma, Meudon, France

[73] Assignee: Electricite de France (Service National), Paris, France

[21] Appl. No.: 148,589

[22] Filed: Jan. 26, 1988

[30] Foreign Application Priority Data

Jan. 28, 1987 [FR] France ..... 87 00994

[51] Int. Cl.[5] ..... B08B 1/00

[52] U.S. Cl. ..... 134/166 R; 134/177; 134/201; 15/104.05; 901/44

[58] Field of Search ..... 134/1, 18, 166 R, 167 R, 134/172, 175, 177, 201; 15/21 R, 56, 104.05; 901/41, 43, 44; 118/317

[56] References Cited

U.S. PATENT DOCUMENTS

| | | | |
|---|---|---|---|
| 3,599,871 | 8/1971 | Ruppel et al. | 239/265 X |
| 3,741,808 | 6/1973 | Stalker | 134/167 R X |
| 4,220,170 | 9/1980 | Herbert et al. | 134/167 R |
| 4,244,296 | 1/1981 | Vertut | 15/104.05 X |
| 4,244,523 | 1/1981 | Louper | 134/167 R X |
| 4,326,317 | 4/1982 | Smith | 15/302 |
| 4,646,768 | 3/1987 | Tanaka et al. | 134/167 R |
| 4,672,741 | 6/1987 | Zarfred et al. | 901/41 |

FOREIGN PATENT DOCUMENTS

| | | |
|---|---|---|
| 0146833 | 4/1983 | European Pat. Off. . |
| 0178971 | 4/1986 | European Pat. Off. . |
| 2544123 | 7/1983 | France . |
| 2566309 | 6/1984 | France . |

*Primary Examiner*—Frankie L. Stinson

[57] ABSTRACT

A system for working on the water box of a nuclear power station steam generator comprises a first member having a substantially elongate shape and forming a first arm of the system and a second member having a substantially elongate shape. The second member is articulated at one end to one end of the first member. The combination of the first and second arms is adapted to be inserted into the water box of the steam generator through the manhole. The second member may be moved to a deployed position relative to the first member. A vehicle mounted on and mobile relative to the second arm is used to scan and decontaminate the various parts of the water box of the steam generator. A working device such as a decontamination device is carried by the vehicle. It is able to reach a plurality of areas on the internal surface of the steam generator. A remote control system is provided for the vehicle and the working device.

24 Claims, 21 Drawing Sheets

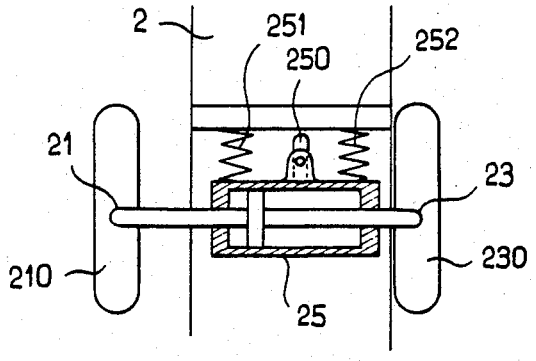
FIG. 6a
FIG. 6b
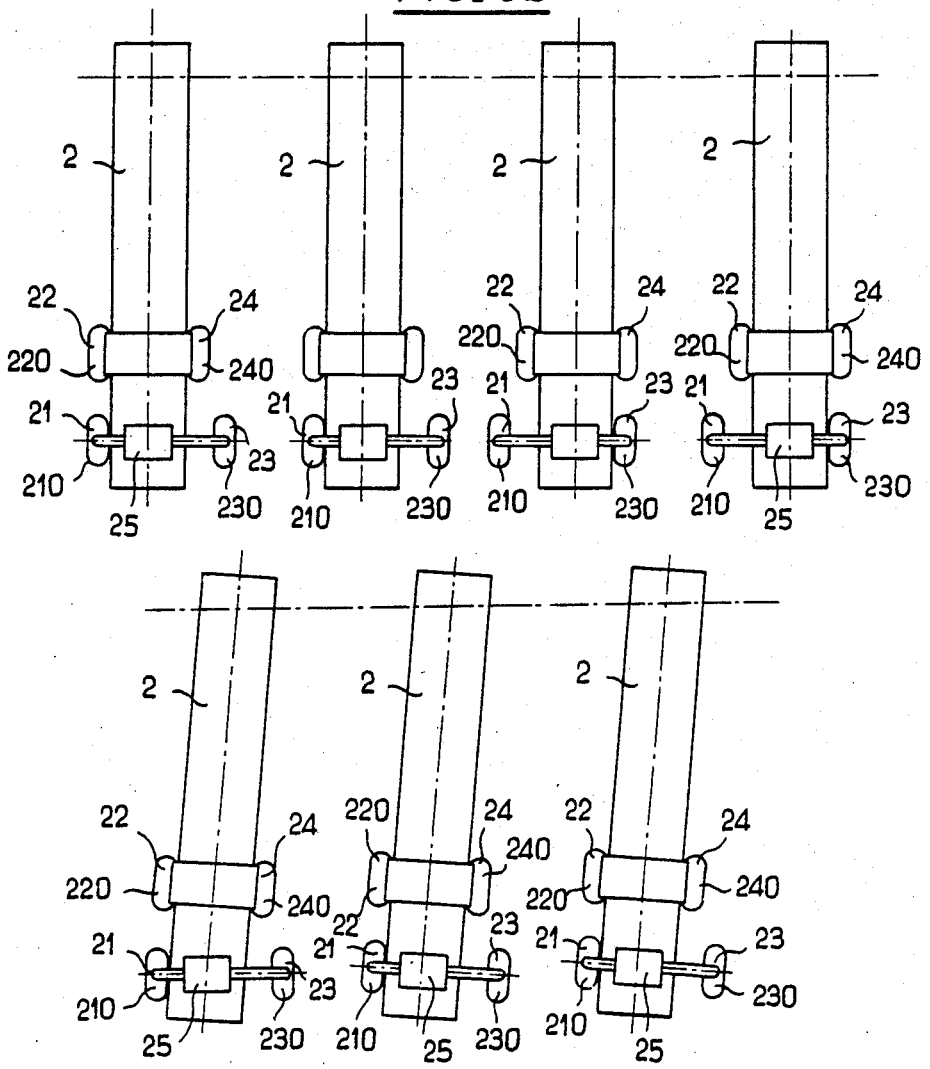

SYSTEM FOR WORKING ON THE PRIMARY PIPEWORK AND WATER BOX OF A NUCLEAR POWER STATION STEAM GENERATOR

BACKGROUND OF THE INVENTION

1. Field of the Invention

The present invention relates to a system for working on the primary pipework and the water box of a nuclear power station steam generator.

2. Description of the Prior Art

As part of replacing a nuclear power station steam generator operations such as cutting pipes, chamfering and welding have to be carried out on the parts to be replaced and in particular on the water box. The dose of radiation received by the operators during these operations is high because of contamination by radioactive substances which are deposited on the internal walls of the aforementioned parts.

One way to reduce the aforementioned doses received during this type of work might consist, prior to the work necessary to carry out these operations, in decontaminating the primary pipework of the water box over a length in the order of several, meters, for example, the internal wall of the water box and the partition plate, for example.

Such decontamination may be effected by electrodecontamination, for example, and advantageously by working from outside the water box using the system in accordance with the invention.

SUMMARY OF THE INVENTION

The system in accordance with the invention for working on the primary pipework and the water box of nuclear power station steam generators is remarkable in that it comprises a first member having a substantially elongated shape and forming a first arm of the system and a second member having a substantially elongate shape articulated at one end to one end of the first member, the second member forming a second arm of the system. The combination of the first and second arms is adapted to be inserted into the water box of the steam generator through a manhole and said second member may be placed in a deployed position relative to the first member. A vehicle is mounted on the second arm, the vehicle being mounted so as to be movable relative to the second arm, and decontamination means are carried by the vehicle. By virtue of its movement relative to the second arm and of the relative opening between the first and second arms, the working means are adapted to reach a plurality of areas on the internal surface of the steam generator such as, in particular, the primary pipework, the partition plate and the internal wall of the spherical bowl of the steam generator water box. Remote control means for the vehicle and the working means are also provided.

The system in accordance with the invention may advantageously be used prior to any work carried out by an operator on or in the water box of a steam generator, for operations such as plugging tubes, testing tubes and fitting obturator plugs.

It is remarkable in that work such as decontamination can be carried out and controlled from outside the water box of the steam generator, any operator having to enter or leave the water box of a steam generator prior to decontamination carried out by means of the system in accordance with the invention being exposed to an excessively high dose of radiation.

The invention will be better understood from a reading of the following description with reference to the accompanying drawings.

BRIEF DESCRIPTION OF THE DRAWINGS

FIGS. 6*a* and 6*b* show diagrams of the various phases of displacement of the second member forming an arm, by means of the vehicle, in the embodiment of the system in accordance with the invention shown in FIG. 5*a*.

DESCRIPTION OF THE PREFERRED EMBODIMENTS

Figure 1A:
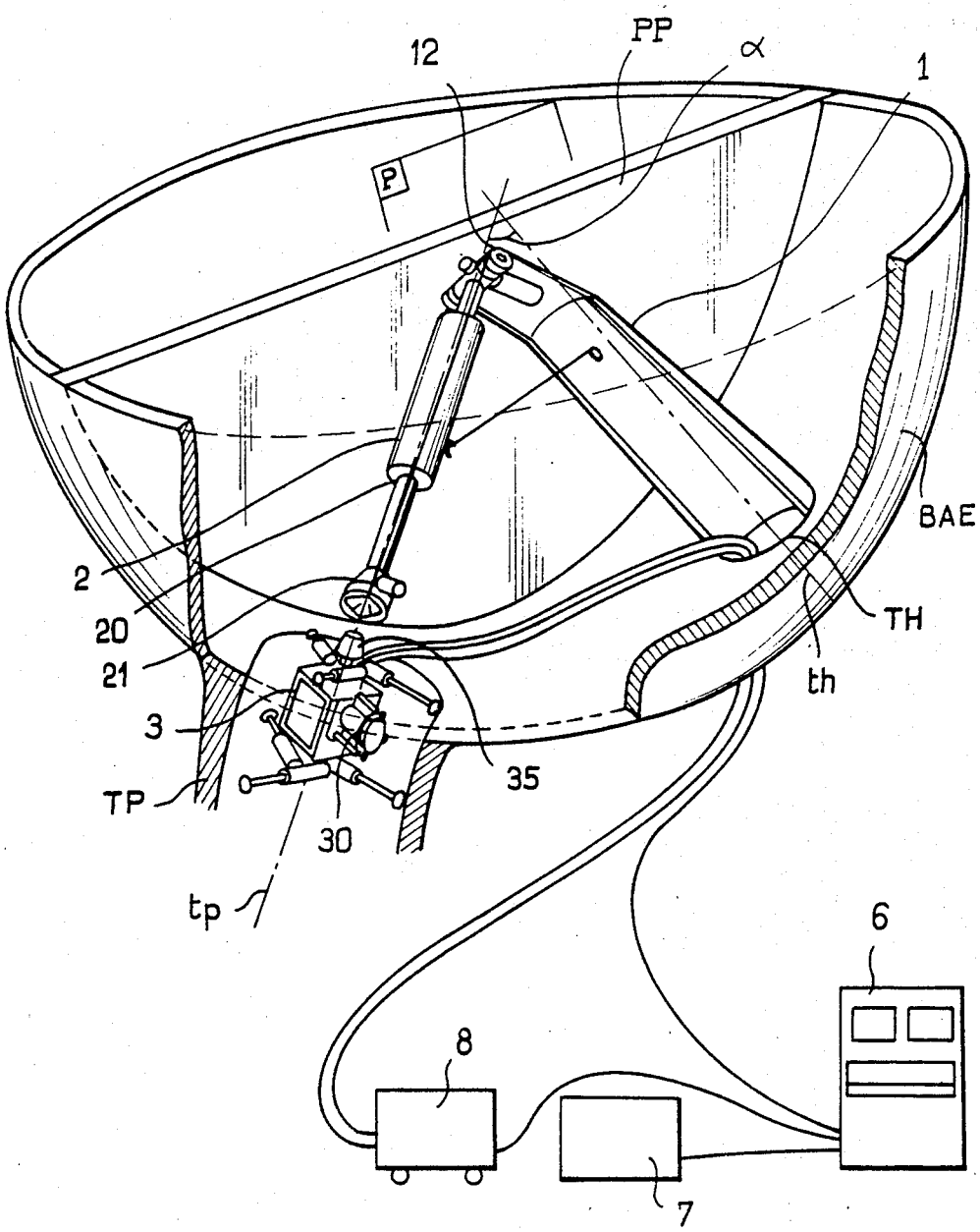
FIG. 1*a* shows a partly cut away perspective view of a system in accordance with the invention more specifically adapted to decontaminating the primary pipework of the water box of a steam generator.

The system for working on the primary pipework and on the water box of a nuclear power station steam generator will first be described with reference to FIG. 1*a*.

As shown in the aforementioned figure, the system for working on the primary pipework and on the water box of nuclear power station steam generators comprises a first member denoted 1 having a substantially elongate shape and forming a first arm of the system. It further comprises a second member denoted 2 also having a substantially elongate shape, this second member being articulated at one end 12 to one end of the first member denoted 1. The second member 2 forms a second arm of the system and the combination of the first arm 1 and the second arm 2 is adpated to be inserted into the steam generator water box, denoted BAE in FIG. 1*a*, through the manhole denoted TH. Thus the second member 2 may be placed in a deployed position relative to the first member 1, in which position it is deployed through an angle $\alpha$ as shown in FIG. 1*a*.

Furthermore, as seen in FIG. 1*a*, a vehicle denoted 3 is mounted on the second arm 2. The vehicle 3 is mounted to be movable relative to the second arm 2 as will be described in more detail hereinafter in the description.

Working means such as decontamination means 30 are carried by the vehicle 3, moreover. By virtue of its movement relative to the second arm 2 and of the relative angular displacement between the first arm 1 and the second arm 2, the working means 30 are adapted to reach a plurality of areas on the internal surface of the steam generator, such as the primary pipework denoted TP, the partition plate denoted PP and the internal wall of the spherical bowl of the steam generator water box denoted BAE in particular.

Moreover, as shown in FIG. 1*a*, control means 6 are provided to enable remote control of the vehicle 3 and of the working means 30 from outside the water box BAE of the steam generator. Associated with the aforementioned control means 6 there are also auxiliary members such as an electrical power supply system denoted 7 and a storage tank for decontaminating products denoted 8. These two accessory auxiliary members will be described in more detail later in the text of the present description.

The axis of symmetry of the manhole denoted th in FIG. 1*a* and the axis of symmetry of the primary pipework denoted tp in the same figure both being situated in the same plane denoted P, the device in accordance with the invention is based on the theory of the compass and so, by virtue of deployment of the second arm denoted 2 relative to the first arm denoted 1, makes it possible to reach substantially all points inside the water box BAE of the steam generator which have to be submitted to a decontamination process as will be described hereinafter in the description.

In one particularly advantageous but non-limiting embodiment shown in FIG. 1*a*, the first member 1 is a hollow $\Psi$ member of substantially semi-cylindrical shape so as to form a protective jacket for the second member 2 when the latter is in the non-deployed position. The non-deployed position is to be understood as that for which the value of the angle $\alpha$ is substantially zero, the second member or second arm 2 being then folded against the first member or first arm 1 and inside the hollow part of the latter.

A more specific description of the system in accordance with the invention in the case where the latter serves to decontaminate the primary pipework denoted TP of a steam generator will be given with reference to FIGS. 1*a*, 1*b* and 2*a*, 2*b* hereinafter.

In the aforementioned case, the second arm denoted 2 is advantageously constituted by a telescopic arm denoted 20 and the vehicle 3 is then removably mounted at the end of the second member 2 forming the second arm. The telescopic arm 20 may be constituted in the conventional way by an arm fitted with a hydraulic piston-and-cylinder actuator controlled by the control means 6. The removable fixing of the vehicle 3 to the end of the telescopic arm 20 may advantageously be achieved by means of a gripper 21 controlled by the control means 6 and a corresponding fixing system 35 fastened directly to the vehicle 3 as will be described later in the description.

The vehicle 3 having been positioned at the inlet to the primary pipework TP by means of the telescopic arm 20 controlled by the control means 6, the releasing of the gripper 21 is then commanded, of course, and the vehicle 3, which is a self-propelled vehicle as will be explained later in the description, can then move inside the aforementioned primary pipework TP.

Figure 1B:
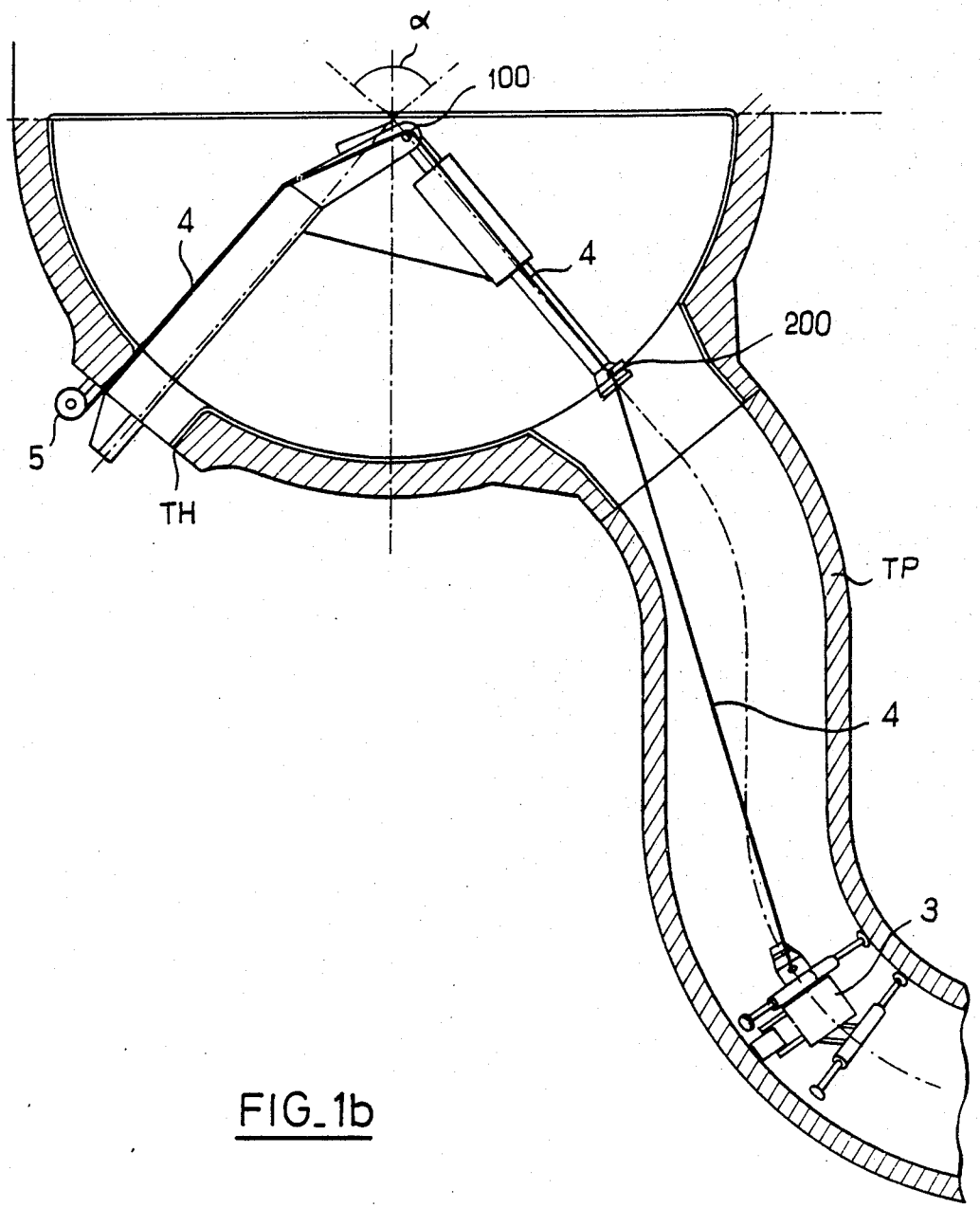
FIG. 1*b* shows a view in partial cross-section on a plane of symmetry common to the manhole TH and to the primary pipework TP of the water box of a steam generator and of the system in accordance with the invention, as shown in FIG. 1*a*.

In FIG. 1*b* is shown a view in partial cross-section on a plane of symmetry common to the manhole TH and to the primary pipework TP of the water box of a steam generator and of the system in accordance with the invention, the vehicle 3 having moved inside the primary pipework TP.

As will be noted in the aforementioned FIG. 1*b*, the vehicle is mechanically attached to a tensioning cable denoted 4, the tensioning cable being paid out or drawn in as the removable vehicle 3 moves inside the primary pipework TP by means of pulleys denoted 200 at the end of the second arm 2 and pulleys denoted 100 articulating together the first and second arms, for example. It is to be understood that by "pulley" is meant any appropriate guiding means enabling displacement of the cable without damaging wear of the latter and in particular, where appropriate, guide grooves provided with a self-lubricting coating, for example, such as coating of polytetrafluorethylene. As is also shown in FIG. 1*b*, the tensioning cable 4 is paid out from and drawn back onto a balancer winder denoted 5 situated in the vicinity of the free end of the first member 1 outside the manhole TH when the system and in particular the member 1 is in position, as will be described later in the description.

Thus the vehicle 3 serves to move the decontamination means 30 along the primary pipework TP.

Generally speaking, the vehicle serves to impart to the decontamination means 30 rotational movement about the axis of the pipework TP during decontamination and stepwise longitudinal movement whereby the combination of the vehicle 3 and decontamination means 30 advances along the length of the pipework.

A more detailled description of the vehicle 3 will be given with reference to FIGS. 2*a* and 2*b*.

Figure 2A:
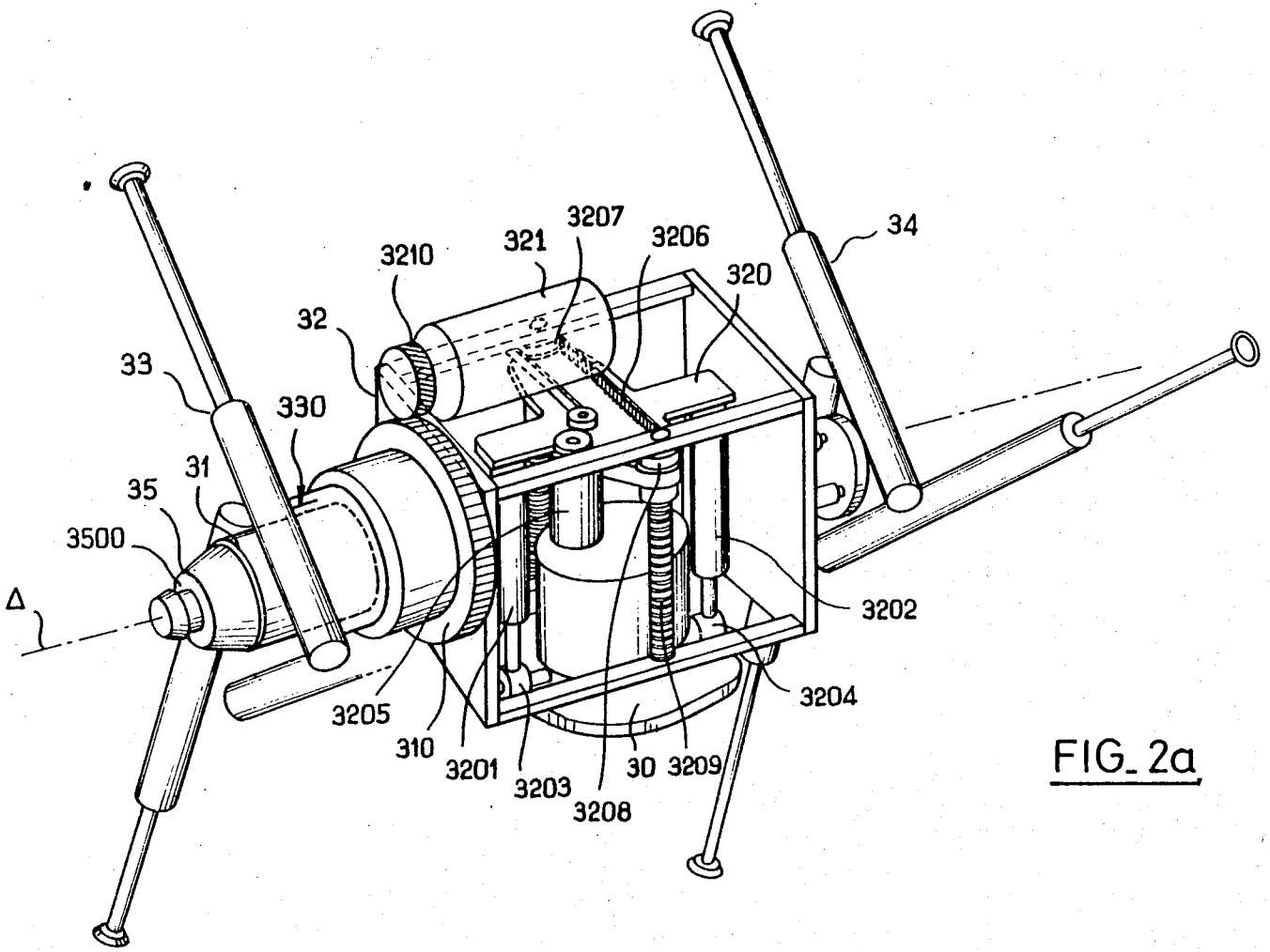
FIG. 2*a* shows a perspective view of an essential part of the system in accordance with the invention as shown in FIGS. 1*a* and 1*b*, this essential part consisting of the vehicle carrying the decontamination member.

Referring to the aforementioned FIG. 2*a*, the vehicle 3 may advantageously comprise a vehicle body denoted 31 constituted by a longitudinal member disposed along the longitudinal axis $\Delta$ of the vehicle. The latter also comprises a chassis 32 rotatably mounted on the longitudinal member forming the vehicle body 31. The chassis 32 comprises a plate denoted 320 adapted to support the decontamination means 30. Also, as will be noted in FIG. 2*a*, means are provided for supporting the vehicle 3. These supporting means are constituted by a first set of piston-and-cylinder actuators denoted 33 and a second set of piston-and-cylinder actuators denoted 34. Each set of actuators is fastened to the vehicle body 31 and has a tripod configuration in a plane orthogonal to the longitudinal axis Δ of the vehicle. Each component actuator of the actuator sets 33 and 34 is provided at the end with an application sucker adapted to bear against the internal wall of the primary pipework TP. It will be noted in FIG. 2*a* that the set of actuators 33 has been shown with only two actuators, the third actuator having been omitted to avoid unnecessary overcomplication of the drawing.

In an advantageous embodiment of the vehicle 3 as shown in FIG. 2*a*, the chassis 32 is mounted on the longitudinal member 31 so that it can be rotated by means of a toothed ring 310 and a motor 321 comprising a gearwheel meshing with the aforementioned toothed ring. The motor 321 is, of course, fastened to the chassis 32. Rotation of the gearwheel of the motor 321 thus rotates the chassis 32 and all the members attached to it.

As will also be noted in FIG. 2*a*, the decontamination means 30 are supported by the plate 320 through the intermediary of actuators denoted 3201, 3202. The actuators 3201, 3202 are each coupled to the decontamination means by a ball-joint 3203, 3204. Translation of the assembly in the radial direction, that is to say in a direction orthogonal to the longitudinal axis of the vehicle body 31, is obtained by means of a motor 3205 fastened to the decontamination means 30, to enable these means to be applied against the primary pipework wall to be treated. It will be noted in FIGS. 2*a* and 2*b* in particular that the motor 3205 is fastened to the plate 320 and therefore to the decontamination means 30, the motor 3205 meshing with a transmission system 3206 which drives two nuts 3207, 3208 which respectively drive the plate 320 and the decontamination means 30, through the intermediary of two threaded rods 3209 fastened to the chassis 32. Rotation of the motor 3205 thus serves to move the transmission system 3206 and to displace in translation the assembly constituted by the plate 320, the motor 3205 and the decontamination means 30, in a direction perpendicular to the axis δ. It will also be noted in FIGS. 2*a* and 2*b* that the vehicle body 31 comprises at one end a frustoconical part 35 provided with a groove 3500 and is adapted to be inserted into the gripper disposed at the end of the telescopic arm 20.

A more detailed description of the vehicle shown in FIG. 2*a* will be given with reference to FIG. 2*b* which shows a view in cross-section on a longitudinal plane of symmetry passing through the axis δ of the vehicle.

Figure 2B:
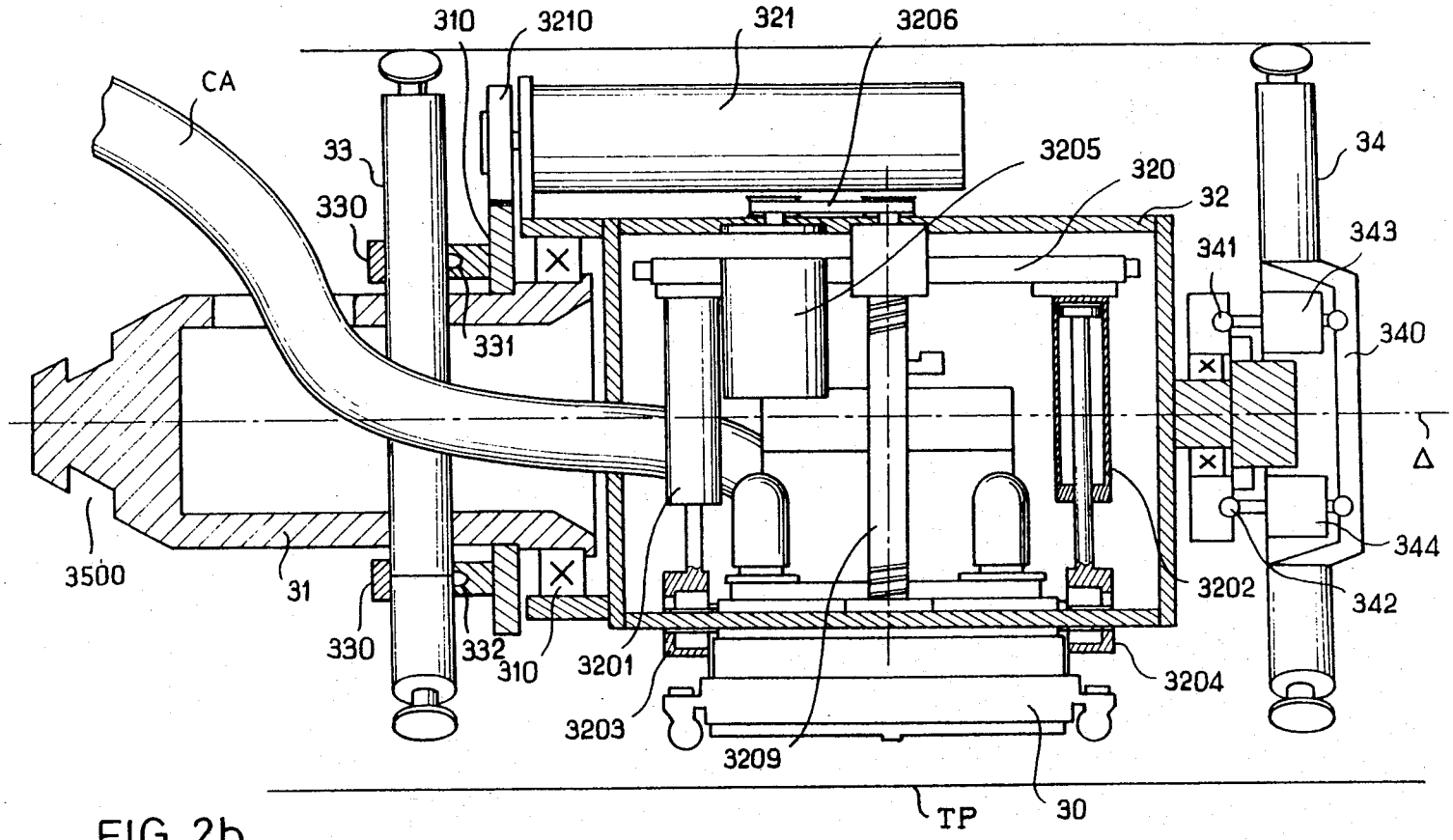
FIG. 2*b* shows a view in partial cross-section on a longitudinal plane of symmetry of FIG. 2*a*.

In FIG. 2*b* in particular there will be noted the presence of a member denoted CA which represents the supply cord to the vehicle, this supply cord being assumed to comprise a pipe for feeding decontaminating liquid or fluid to and removing it from the decontamination means 30, as will be described later in the description, an electrical power supply cable and a hydraulic fluid pipe for operating the various actuators constituting the vehicle 3.

As also seen in FIG. 2*b*, the two sets of actuators 33, 34 are, to enable traction of the vehicle 3 within the primary pipework TP, mounted on a seating plate denoted 330, 340 the orientation of which relative to a plane orthogonal to the longitudinal axis δ of the vehicle body is adjustable through an angle the value of which is determined by means of ball-joint fixings respectively denoted 331, 332 and 341, 342. The ball-joint fixings may be constituted by lockable and unlockable ball-joints. Note that the support or seating plate 330 is in fact mechanically independent of the point at which the tensioning cable is anchored to the vehicle body 31. According to one advantageous characteristic of the system in accordance with the invention, the seating plate 340 is movable in translation in a direction parallel to the longitudinal axis Δ of the vehicle 3 by means of traction actuators denoted 343 and 344. Thus, one or other set of actuators 33 or 34 having been brought into contact with bearing points on the internal wall of the primary pipework TP, displacement of the set of actuators 34 relative to the body of the vehicle followed by fixing, that is to say application of the actuators of the set of actuators 34 to the primary pipework and releasing of the set of actuators 33, consequently enables stepwise translational displacement of the vehicle 3 along the axis of symmetry of the primary pipework TP, as will be described in more detail later in the description.

The vehicle 3 as shown in FIGS. 2*a* and 2*b* serves in particular, and by virtue of the sets of actuators 33 and 34 having the aforementioned tripod configuration, to center and support the vehicle 3 inside the primary pipework TP. The vehicle 3 is advanced by the aforementioned set of actuators 343, 344, which are articulated at their end to enable angular offsetting of the set of actuators 34 relative to the combination constituted by the other set of actuators 33, the vehicle body 31 and the chassis 32 as the assembly moves forward in curved parts of the primary pipework TP.

The vehicle 3 as a whole is supported by the previously mentioned tensioning cables 4 which are actuated so as to prevent the vehicle 3 falling in the event of any failure of one of the sets of actuators 33 or 34.

The primary pipework TP may then be decontaminated in the following manner. The vehicle 3 is lowered to the lowest point in the primary pipework TP to be decontaminated. The walls of the primary pipework TP are then decontaminated by the decontamination means 30, which are rotated about the longitudinal axis Δ of the vehicle through the intermediary of the chassis 32 which is rotated by the aforementioned motor 321. A lateral strip of the primary pipework TP having been decontaminated, the vehicle is then moved by one step and raised by means of the second set of actuators 34 previously described. It is at this time that the tensioning cables 4 fulfill their role as safety means guarding against failure of the aforementioned actuators. The tensioning cable or cables 4 being wound onto the balancer 5, they facilitate the raising of the vehicle 3 especially when the vehicle, and especially the supporting actuators of the sets of actuators 33 and 34, pass over a decontaminated surface, that is to say a surface whose surface state makes adhesion difficult.

A detailed description of the installation of systems in accordance with the invention into the water box BAE of a steam generator from outside the latter will be given with reference to FIGS. 3*a*, 3*b*, 3*c*, 3*d*, 3*e*, 3*f*, 3*g*, 3*h*, 3*i* and 3*j*.

Figure 3A:
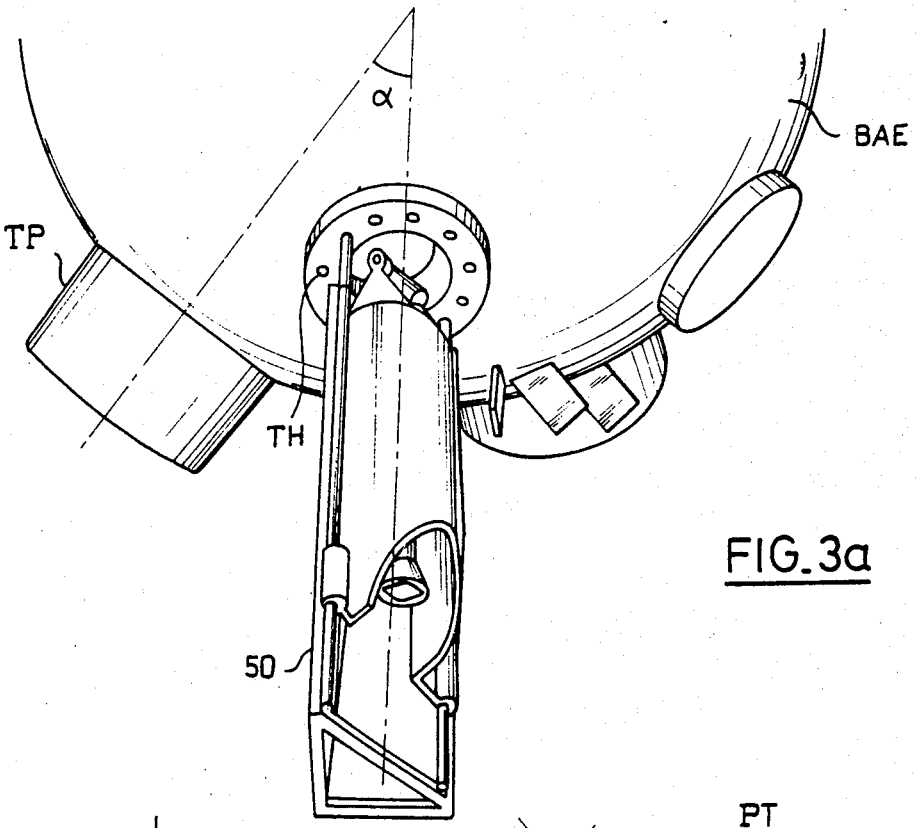
FIGS. 3*a*, 3*b*, 3*c*, 3*d*, 3*e*, 3*f*, 3*g*, 3*h*, 3*i* and 3*j* show the successive stages of placing the vehicle as shown in FIGS. 2*a* and 2*b* into the primary pipework of the water box of a steam generator.
Figure 3B:
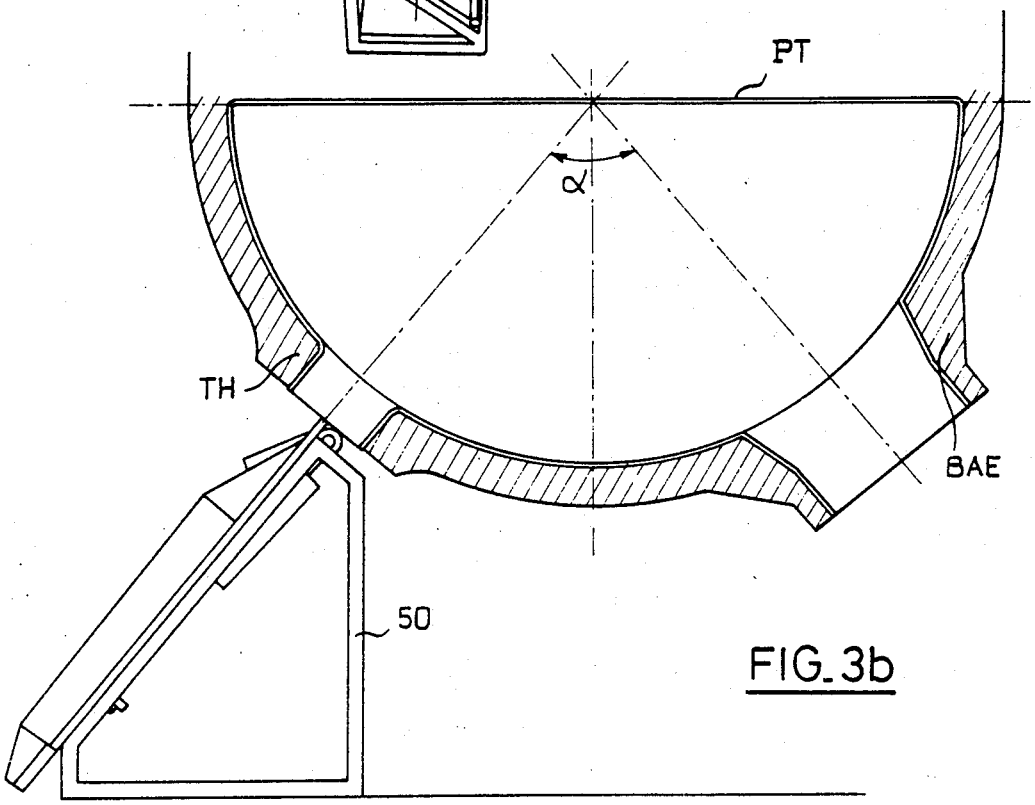
Figure 3C:
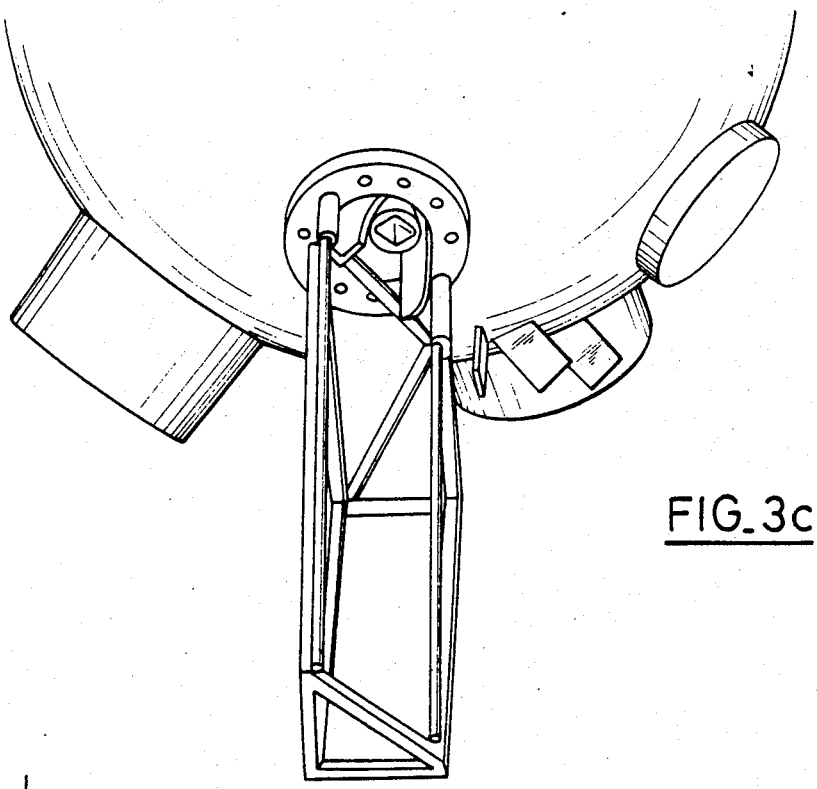
Figure 3D:
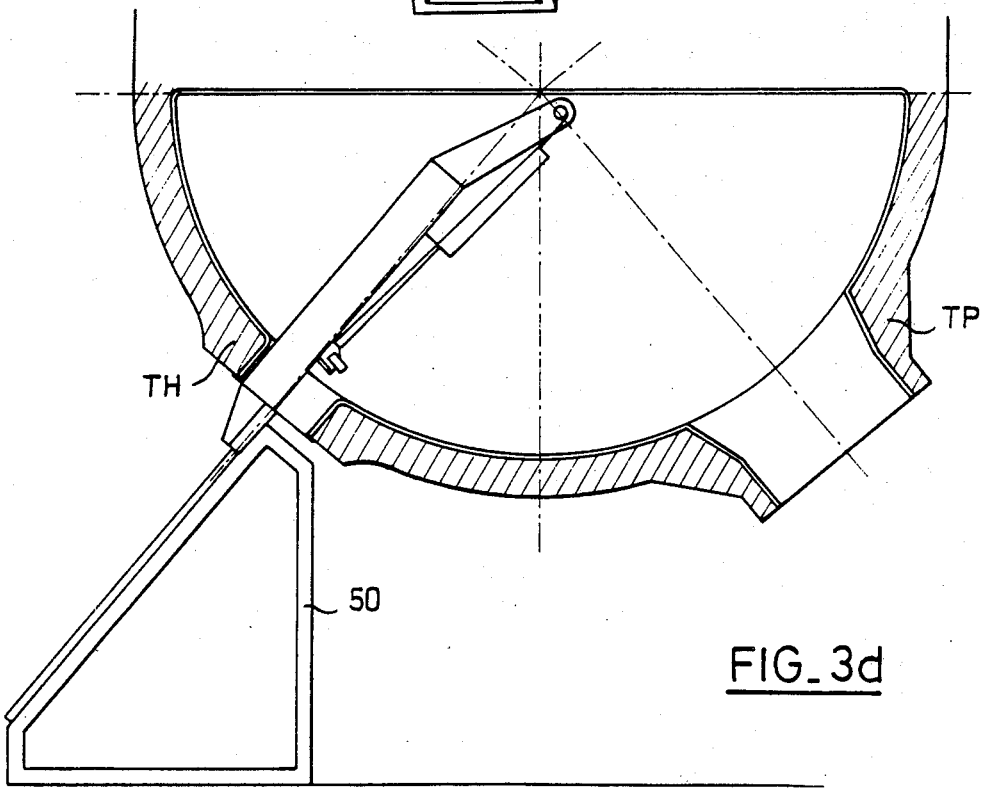
Figure 3E:
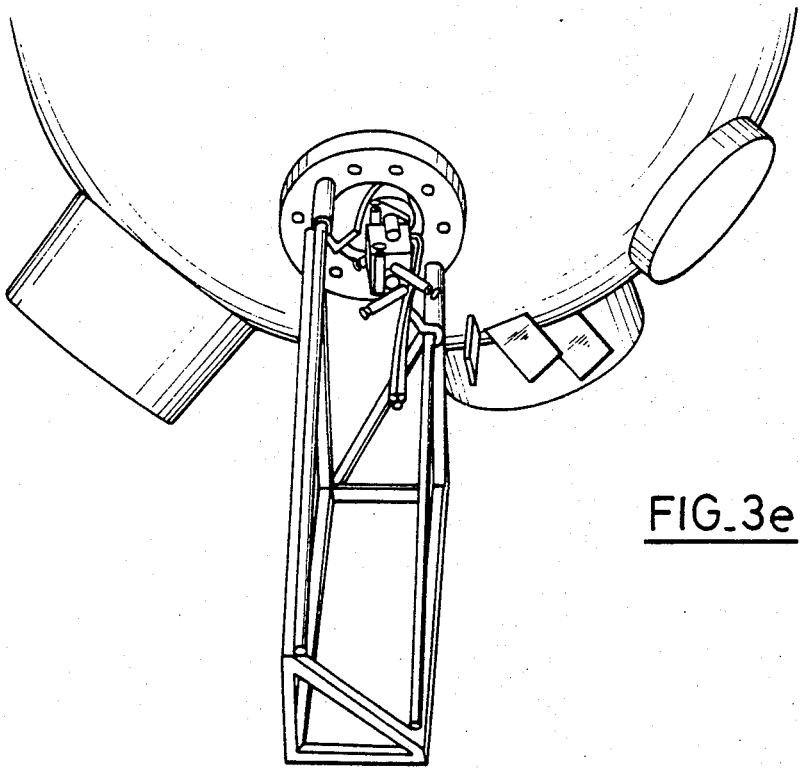
Figure 3F:
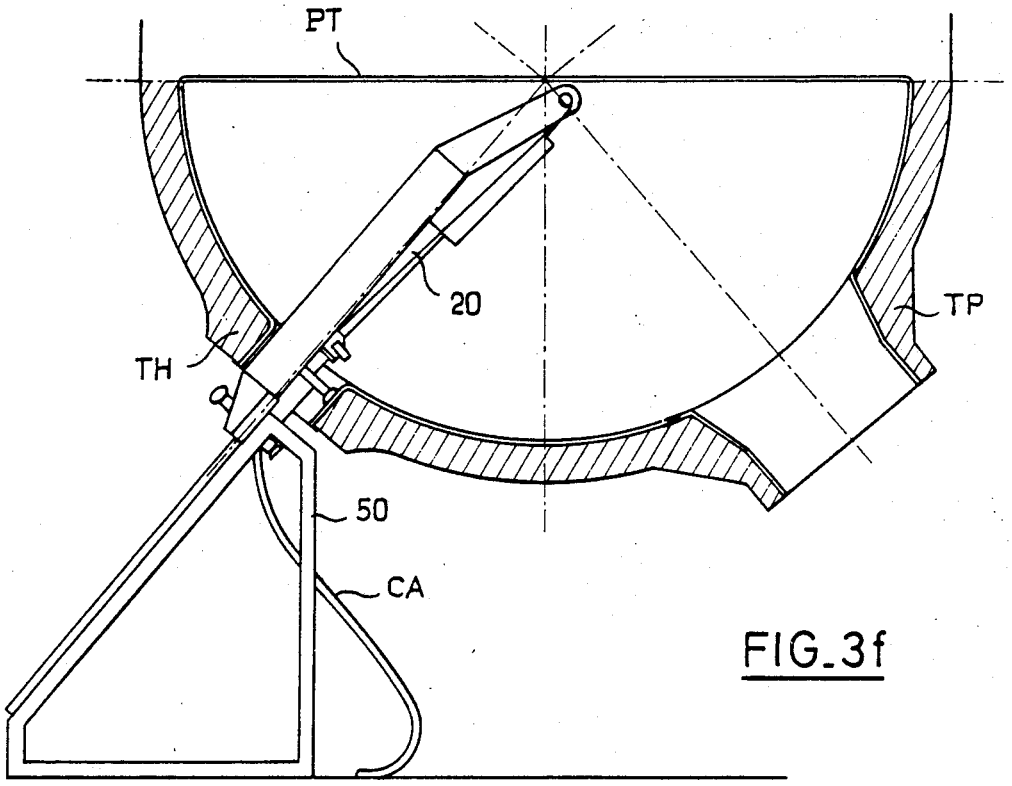
Figure 3G:
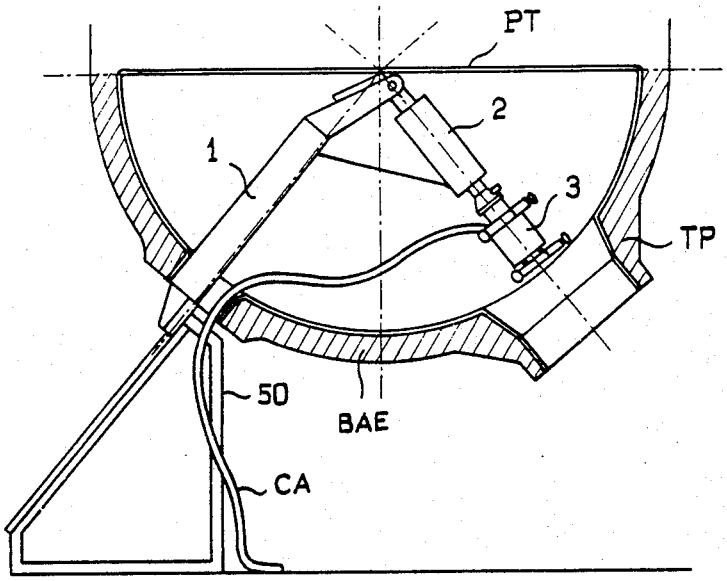
Figure 3H:
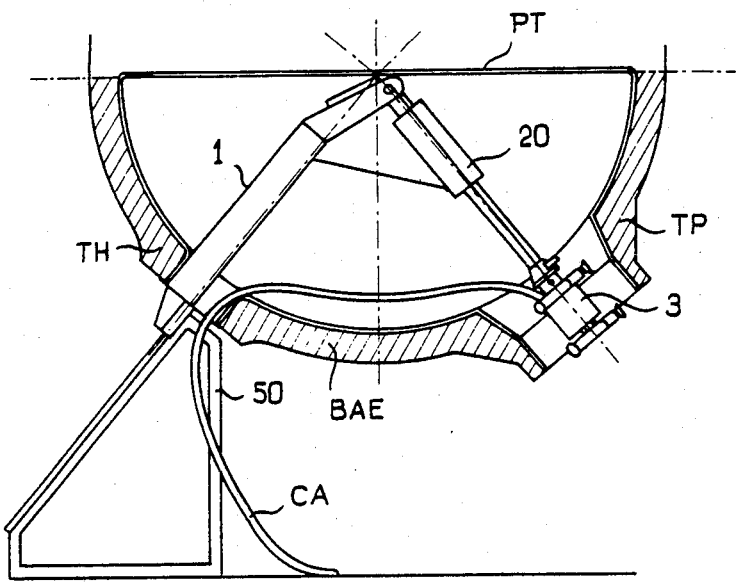
Figure 3I:
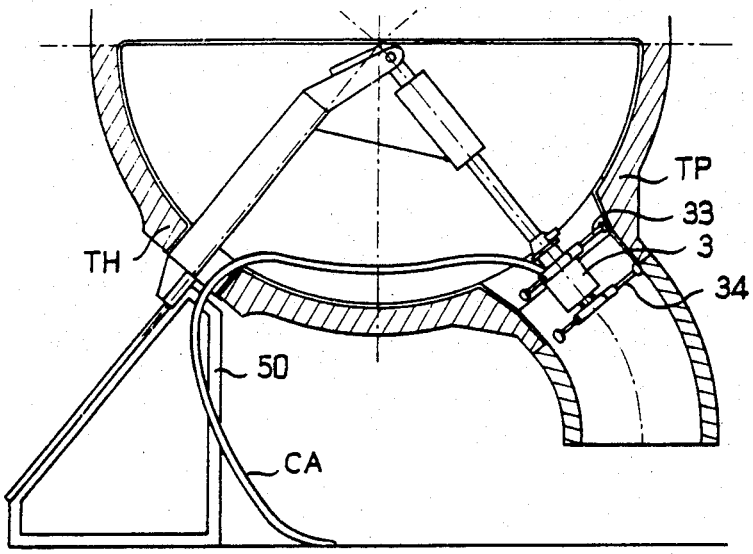
Figure 3J:
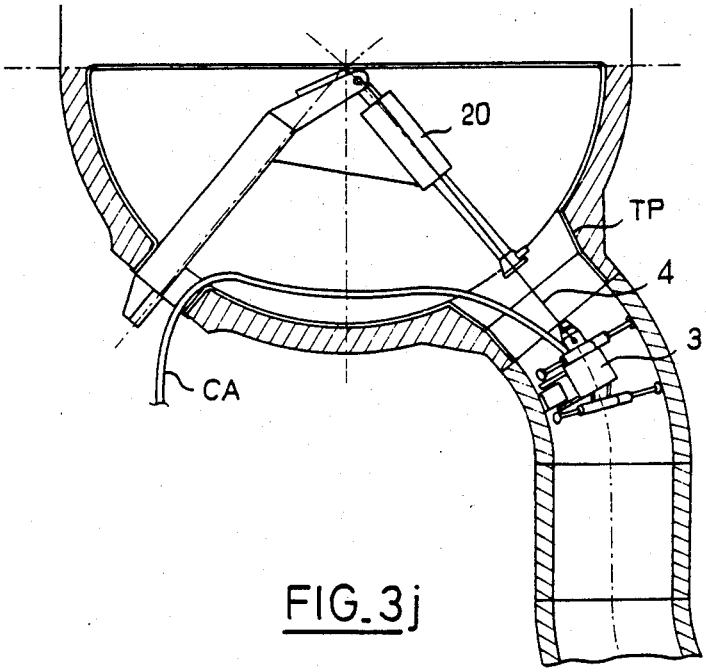
Figure 4A:
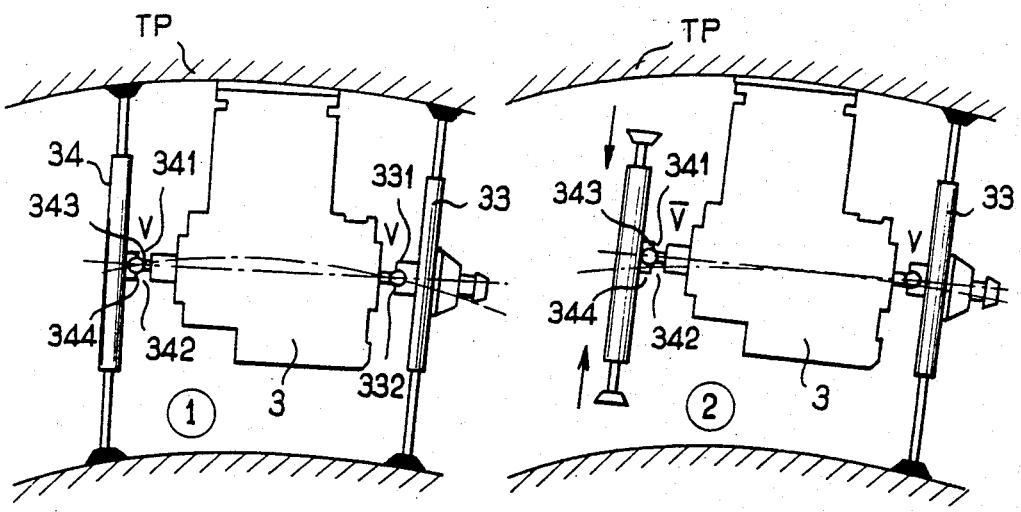
FIGS. 4*a*, 4*b* and 4*c* show how the vehicle is operated in the primary pipework in order to move it along inside the primary pipework.
Figure 4B:
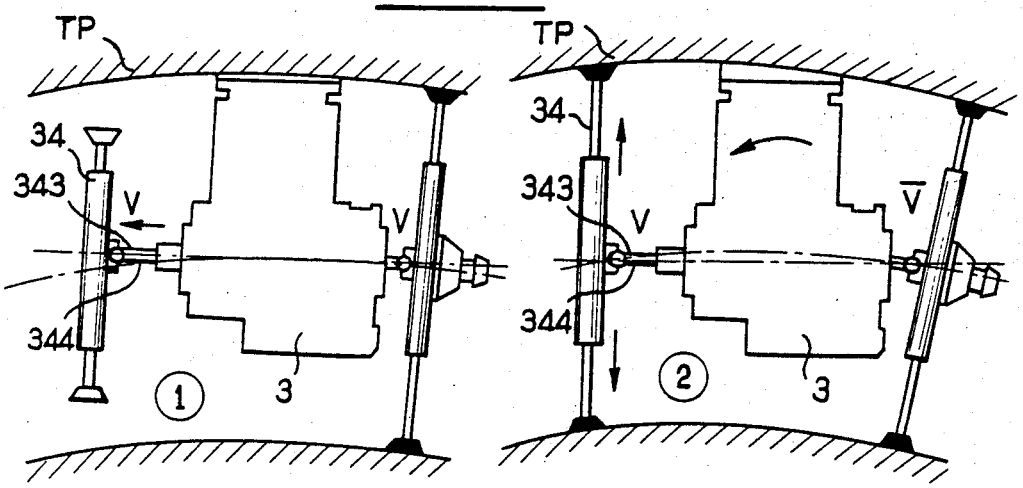
Figure 4C:
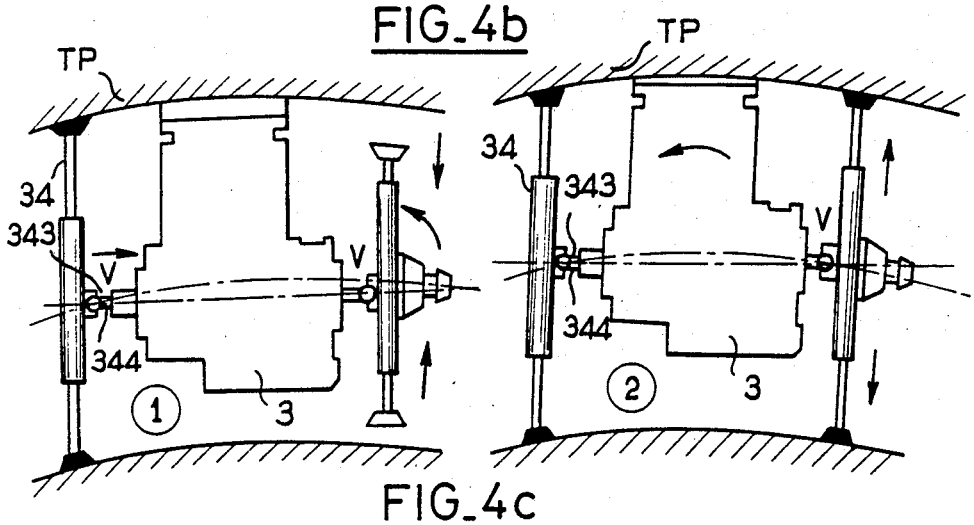

In FIGS. 3*a* and 3*b* there is shown the fitting of the system in accordance with the invention onto a lift denoted 50 brought near the manhole denoted TH. It will be understood that FIG. 3*b* shows a view in cross-section substantially in a plane of symmetry of FIG. 3*a*. The lift system 50 may comprise, for example, an inclined plane the angle of inclination of which makes it possible by mere translation of the assembly, that is to say of the system in accordance with the invention, to position the articulation 12 between the first and second arms in the vicinity of the center of the tube plate denoted TP of the water box of the steam generator.

FIGS. *3c* and *3d* show more particularly the position of the system in accordance with the invention after translation of the system on the lift 50 and positioning of the articulation 12 in the vicinity of the center of the tube plate PT. The position of the assembly being as shown in FIG. *3b*, for example, the vehicle 3 is then (as shown in FIGS. *3e* and *3f*) offered up to the end of the telescopic arm 20 and locked to the end of the latter. The telescopic arm may then be withdrawn to take the vehicle inside the water box BAE. The supply cord is connected beforehand, of course.

Then, as shown in FIG. *3g*, the second member denoted 2 forming an arm is unlocked and moved to the deployed position relative to the first member forming the arm denoted 1. The second member forming the arm 2 is then deployed so as to align it and the vehicle 3 with the primary pipwork TP, as shown in FIG. *3g*. The arm 2 may be deployed by means of a piston-and-cylinder actuator or by means of a motor which rotates the arm 2 into its deployed position.

As shown in FIG. *3h*, the telescopic arm is then actuated so as to insert the vehicle 3 into the primary pipework TP.

The actuators of the sets of actuators 33 and 34 of the vehicle 3 are then operated so as to apply the vehicle 3 to the walls of the primary pipework TP, as shown in FIG. *3i*.

The vehicle 3 may then be disconnected from the telescopic arm 20 by releasing the previously described gripper and the vehicle 3 may be advanced into the primary pipework in the way already mentioned, advancing sequentially along the axis of the pipework.

A more detailed description of the advanced of the vehicle 3, especially in curved parts of the primary pipework TP, will be given with reference to FIGS. *4a*, *4b* and *4c*.

In FIG. *4a* there are shown the two sets of actuators 33 and 34 in the position bearing against the internal wall of the primary pipework TP, in a curved part of the latter. It will be noted in particular that, by virtue of the ball-joint connection between the traction actuators 343 and 341 and the bearing plate 330 and 340, the system can easily be moved in curved parts. In FIG. *4a*, in diagram (1), the actuators constituting the two sets of actuators 33 and 34 are pressurized and serve to apply the suckers against the wall, to serve as bearing points. The ball-joints may then be locked, as represented by the letter V.

In FIG. *4a* diagram (2), the actuators of the set of actuators 34 are depressurized so as to place them in the retracted position, the ball-joints 341 and 342 being unlocked, this position being denoted V.

In FIG. *4b* diagram (1) the set of actuators 33 is pressurized and serves as a point of support for the vehicle 3. The set of actuators 34 is depressurized, on the other hand, and the traction actuators 343 and 344 are then operated by pressurizing them so as to move the second set of actuators 34 in a direction substantially parallel to the tangent to the axis of the primary pipework TP, as shown by the arrow. It will be noted that in FIGS. *4a* through *4c* the axis of the pipework TP is shown is chain-dotted line.

The set of actuators 34 having been moved over a length substantially equal to the travel of the actuators 343 and 344, the actuators of the set of actuators 34 are repressurized, the vehicle 3 being then in its new equilibrium position as shown in FIG. *4b* diagram (2). The protruding length of the piston rods of each actuator of the set of actuators 34 can then be adjusted, using the control means, to obtain perfect centering of the central point of the ball-joints 341, 342 on the axis of the primary pipework TP, the ball-joints 331, 332 being placed in the unlocked position $\overline{V}$ as shown in FIG. *4b* diagram (2).

In FIG. *4a* diagram (1) the actuators of the set of actuators 33 are then depressurized and the traction actuators 343 and 341 are then operated so as to move the vehicle 3 as a whole towards the set of actuators 34. Then, as shown in diagram (2), the actuators of the set of actuators 33 are re-pressurized and the vehicle 3 is in a new stable position shifted by one displacement step along the longitudinal axis of the primary pipework TP. Perfect centering of the central point of the ball-joints 331, 332 on the axis of the primary pipework TP may then be achieved in a similar way to the corresponding centering of the central point of the ball-joints 341, 342 shown in FIG. *4b* diagram (2). The cycle is then repeated, of course, as many times as necessary to cover the entire length of the primary pipework TP to be decontaminated.

The vehicle 3 having been moved inside the primary pipework TP from the lowest point to be treated to the vicinity of the gripper for fixing the vehicle to the telescopic arm 20, the vehicle is then fixed to the telescopic arm 20. To facilitate the operation a video camera may advantageously be fixed to the vehicle 3, in such a way as to faciliate the maneuvers whereby the vehicle and its fixing tip are brought close to the gripper on the telescopic arm 20. When the vehicle 3 is again fixed to the end of the telescopic arm 20, the latter is withdrawn and the member 2 forming an arm is then brought into its non-deployed position corresponding to the position in which it is placed at the beginning of the operation. The system in accordance with the invention may then be withdrawn by means of the lift 50 as previously described.

An advantageous embodiment of the system in accordance with the invention will now be described with reference to FIG. *5a* in the case where the system is more particularly adapted to such work as decontaminating the partition plate denoted PP of the water box of a nuclear power station steam generator. It will be noted that the partition plate PP is a plate substantially orthogonal to the tube plate PT of the steam generator water box, the aforementioned partition plate subdividing the water box substantially into two hemispheres.

As shown in FIG. *5a*, the second member 2 forming the second arm is articulated to the first arm 1 through the intermediary of a universal joint type articulation denoted 120. The articulation 120 advantageously comprises, in its operative position, a first axis denoted D1 substantially parallel to the partition plate PP and a second axis denoted D2 substantially perpendicular to the partition plate PP.

As will also be noted in FIG. *5a*, the vehicle 3 is then mounted to move in translation along the second arm 2.

In order to hold the second arm 2 onto the partition plate PP and to move it on the latter, the second arm 2 advantageously comprises a central first actuator denoted 200 serving to fix the combination constituted by the first arm denoted 1 and the second arm denoted 2 in translation in the direction D2 perpendicular to the partition plate PP.

Also, a plurality of actuators respectively denoted 21, 22 and 23, 24 are disposed at the free end of the second arm 2 or in the vicinity thereof. In accordance with another advantageous characteristic of the device in accordance with the invention, at least two opposed actuators, the actuators 21 and 23, for example, form an assembly movable relative to the second arm, this mobile assembly being movable perpendicularly to the direction Δ', the longitudinal axis of the second arm 2, this direction of displacement being parallel to the partition plate PP. This displacement serves to procure the corresponding displacement of the second arm 2 relative to the axis D2 forming the rotation axis for the second arm 2 relative to the fixed point formed by the central actuator 200. The set of actuators 21, 22, 23 and 24 is of course provided at the free end of the piston rod with a respective fixing sucker denoted 210, 220, 230 and 240. The suckers are attached, of course, by depressurizing them. In the same way the actuator 200 forming the central actuator is provided with a sucker 201 serving to apply the system in accordance with the invention at the level of the articulation 120 between the arms 1 and 2 to a point in the vicinity of the central point of the previously described tube plate PT.

The vehicle 3 is of course provided with decontamination means such as those described with reference to the previous embodiment.

A more detailed description of placing the system in accordance with the invention in position in the case where the latter is more particularly adapted for work such as decontaminating the partition plate PP of the water box BAE of a steam generator will be given with reference to FIGS. 5*b* and 5*c*.

Figure 5A:
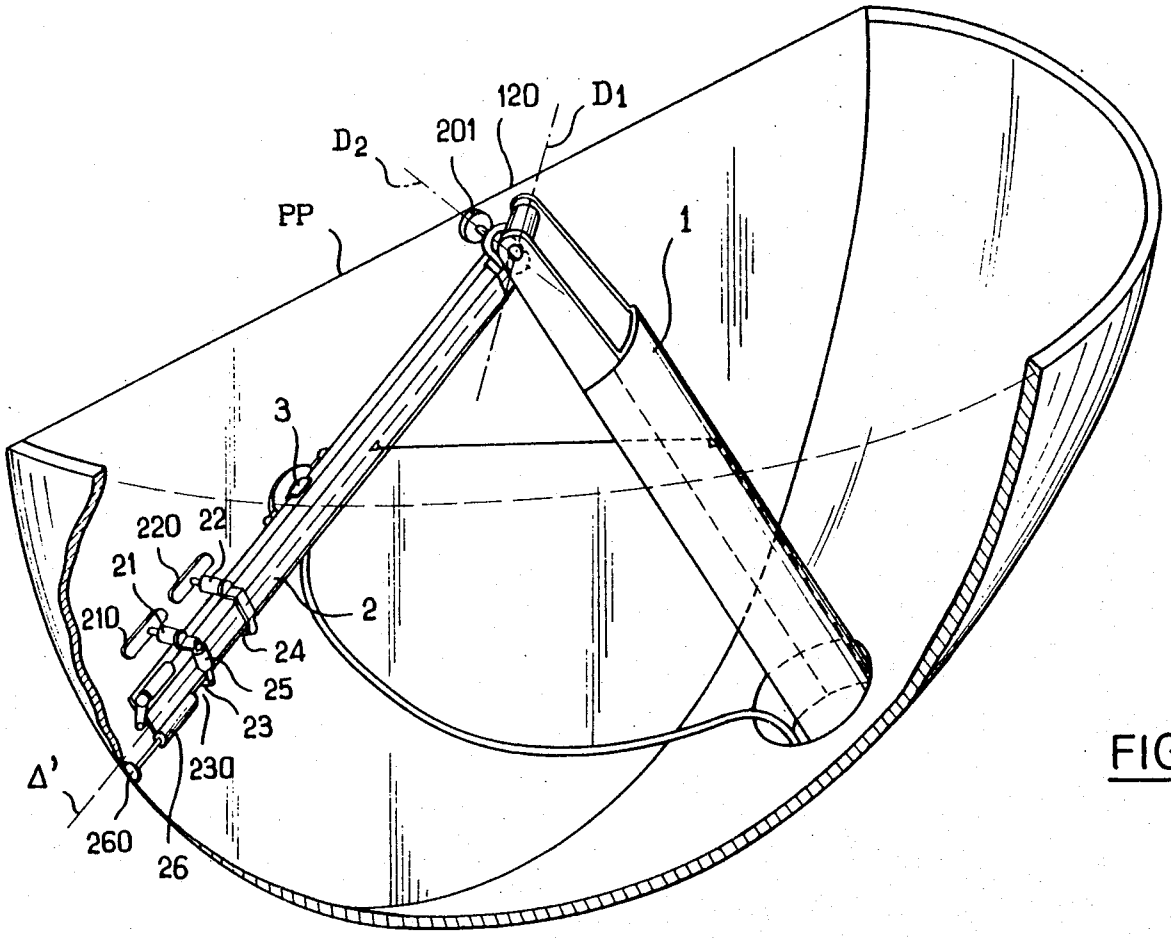
FIG. 5*a* shows a partially cut away perspective view of a system in accordance with the invention more specifically adapted for decontamination of the partition plate of the water box of a nuclear power station steam generator.
Figure 5B:
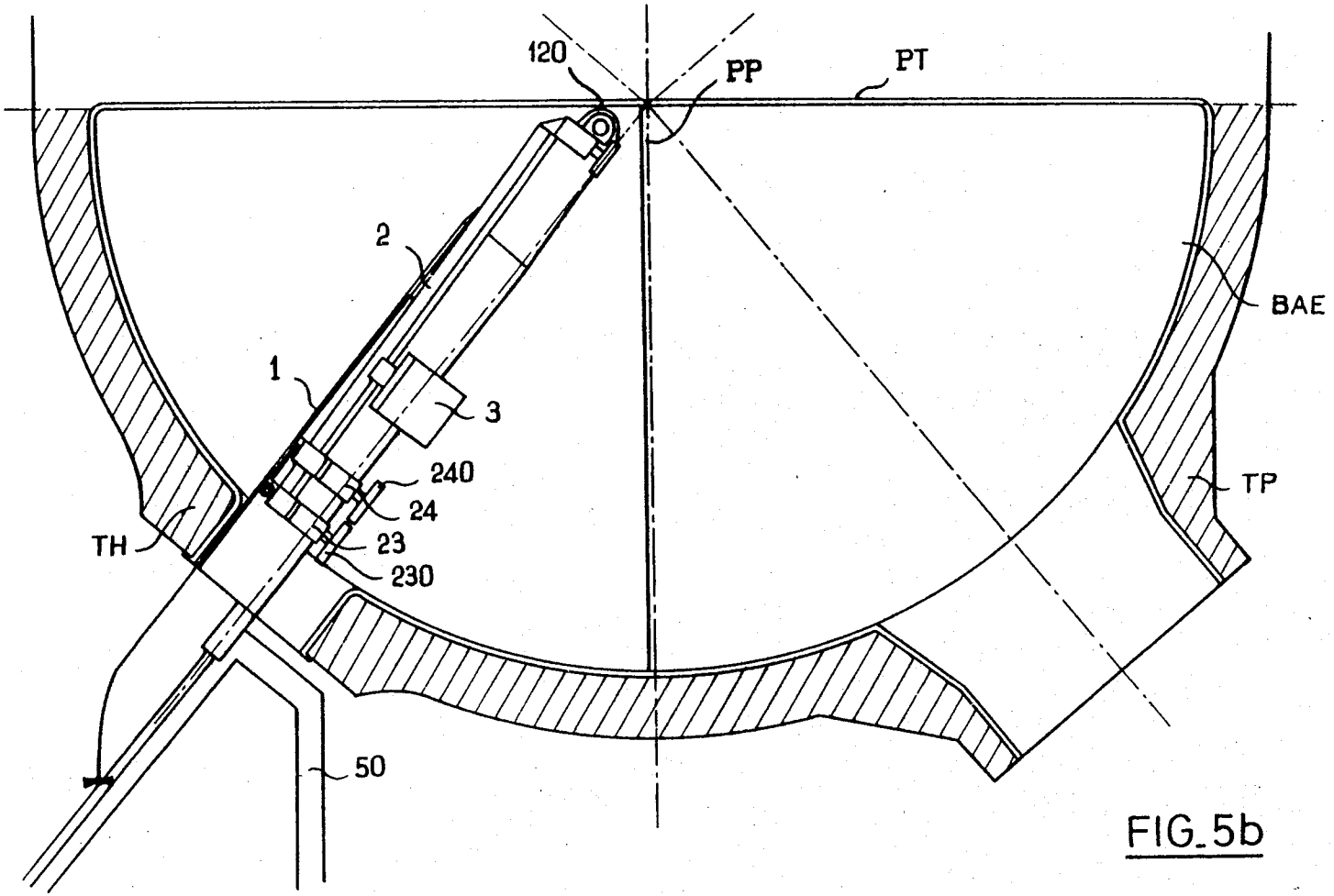
FIGS. 5*b* and 5*c* show a view in partial cross-section relating to the stages of installing the system in accordance with the invention as shown in FIG. 5*a*.

In FIG. 5*b*, the system in accordance with the invention has been placed in the manhole TH by means of a lift 50, as previously described. It will be noted in the aforementioned FIG. 5*b* that the articulation 120 has been moved to the vicinity of the center of the tube plate PT of the steam generator. The system is then raised by translation on the lift 50 and inserted into the manhole TH, being then locked onto dummy pins fixed to the flange of the manhole. Thus the system in accordance with the invention is in the position as shown in FIG. 5*b*. The member 2 forming an arm is then retracted into the hollow part of the arm 1 which has a semi-cylindrical hollow part, for example, as previously described.

Figure 5C:
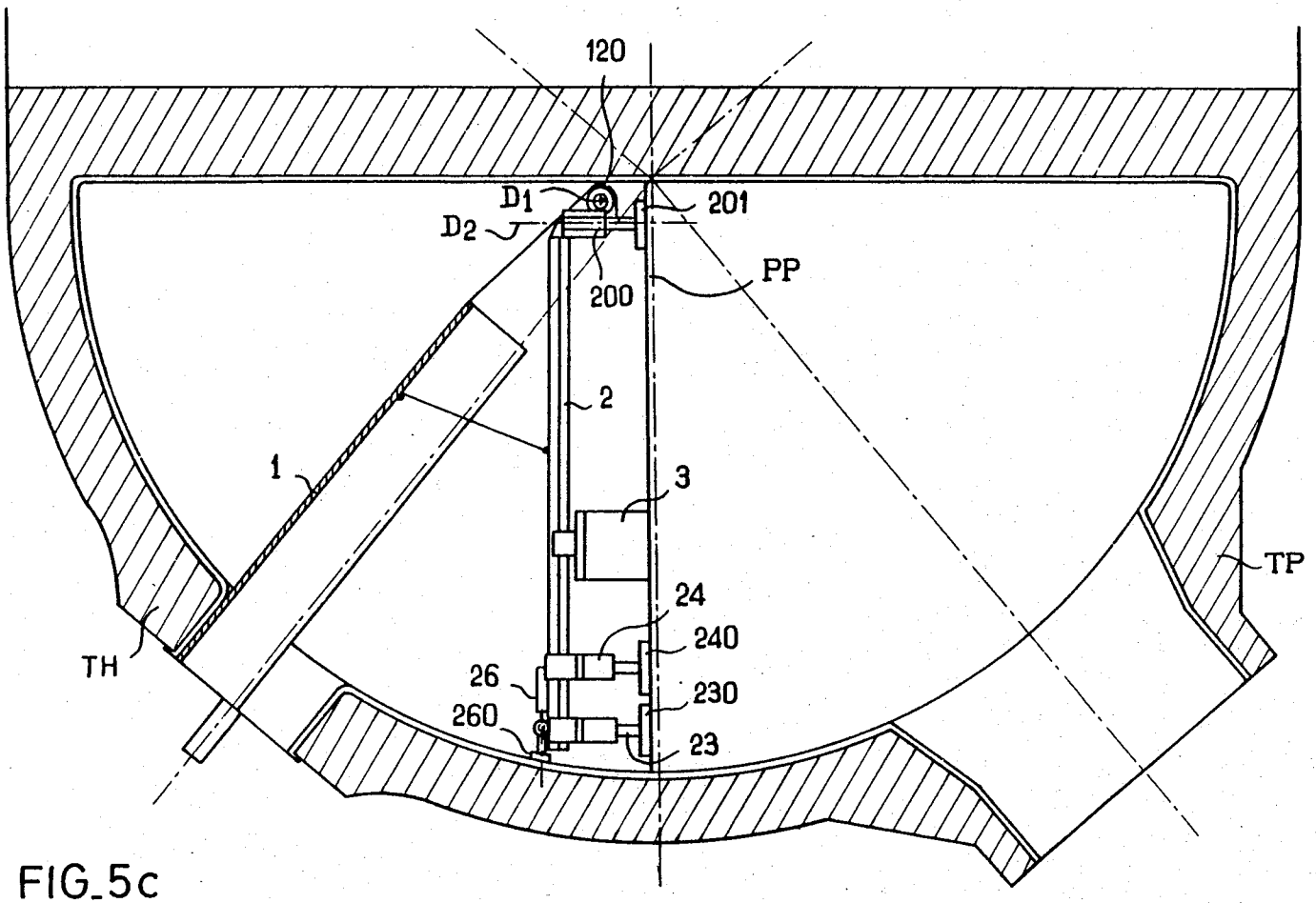

Then, after fixing the member 1 forming an arm to the flange of the manhole TH, the member 2 forming an arm is caused (as shown in FIG. 5*c*) to rotate about the axis D1, the member 2 forming an arm being thus moved into a position substantially parallel to the partition plate PP, as shown in FIG. 5*c*. To carry out this operation the combination of the member 2 forming the arm and the articulation 120 has been moved to the deployed position relative to the axis D1. The central actuator 200 is then operated, the sucker 201 being then applied to a point near the center of the tube plate PT, as shown in FIG. 5*c*. The actuators 21, 22, 23, 24 will then also be applied to the partition plate PP, as shown in FIG. 5*c* and the corresponding suckers 210, 220, 230, 240 may then be depressurized to hold the arm 2 in position substantially parallel to the partition plate PP.

The principle whereby the member 2 forming an arm for the system in accordance with the invention as shown in FIG. 5*a* is moved will be described with reference to FIGS. 6*a* and 6*b*.

As shown in FIG. 6*a*, the two opposed actuators 21 and 22 forming the mobile assembly are rendered mobile by means of a double-acting actuator denoted 25, the body of which is spring-mounted on the second arm 2 in such a way that it is urged towards an intermediate position. In FIG. 6*a* the spring mounting system comprises two return springs denoted 251 and 252, the actuator 25 being guided as it moves relative to its intermediate position by a pin and slot system denoted 250. It will be easily understood that by operating the double-acting acting actuator 25, depending on the direction in which the corresponding control rod moves, the mobile assembly constituted by the actuators 21 and 23 and their corresponding suckers 210 and 230 is moved in one or other sense in a direction perpendicular to the longitudinal axis of the member 2 forming an arm of the system in accordance with the invention.

In FIG. 6*b* the various stages in the displacement of the mobile assembly constituted by the actuators 21 and 23 and the member 2 forming an arm are respectively shown at 1, 2, 3, 4, 5, 6 and 7.

Starting from a given position of the member 2 forming an arm, the displacement procedure is as follows, relative to the seven positions shown in FIG. 6*b*:

position 1: the suckers 210, 220 are depressurized, position 2: the depressurization of the sucker 210 is discontinued, position 3: the actuator 25 is operated so as to move the mobile assembly formed by the actuators 21 and 23, the actuator 21 and the sucker 210 being detached from the member 2 forming an arm, position 4: the sucker 210 is depressurized and depressurization of the sucker 220 is discontinued, position 5: the actuator 25 is operated which results in translation of the member 2 forming an arm towards the sucker 210 and the actuator 21, position 6: the sucker 220 is depressurized and the depressurization of the sucker 210 is discontinued, the actuator 25 being returned to its intermediate position by the spring means 251 and 252 shown in 6*a*, position 7: the sucker 210 is depressurized.

Position 7 substantially corresponds to the initial position 1 after displacement of the member 2 forming an arm by one rotational displacement increment corresponding to movement of the member 2 forming an arm relative to the mobile assembly constituted by the actuators 21 and 23 operated by the actuator 25.

The vehicle 3 supporting the decontamination means 30 can of course move parallel to the member 2 forming an arm by virtue of a motor driving a lead screw accommodated in the member 2 forming an arm. An arrangement of this kind will not be described in detail as it is within the competence of those skilled in the art.

Moreover, the decontamination means may advantageously be orientable in rotation about an axis perpendicular to the axis of the member 2 forming an arm and to the partition plate PP, as will be described later in the description.

Moreover, a so-called safety actuator denoted 26 may be provided at the free end of the member 2 forming an arm. This actuator is directed towards the longitudinal axis δ' of the second member 2 forming an arm. It serves, in the event of a supply failure, to lock the second member 2 forming an arm into its current position.

Figure 7:
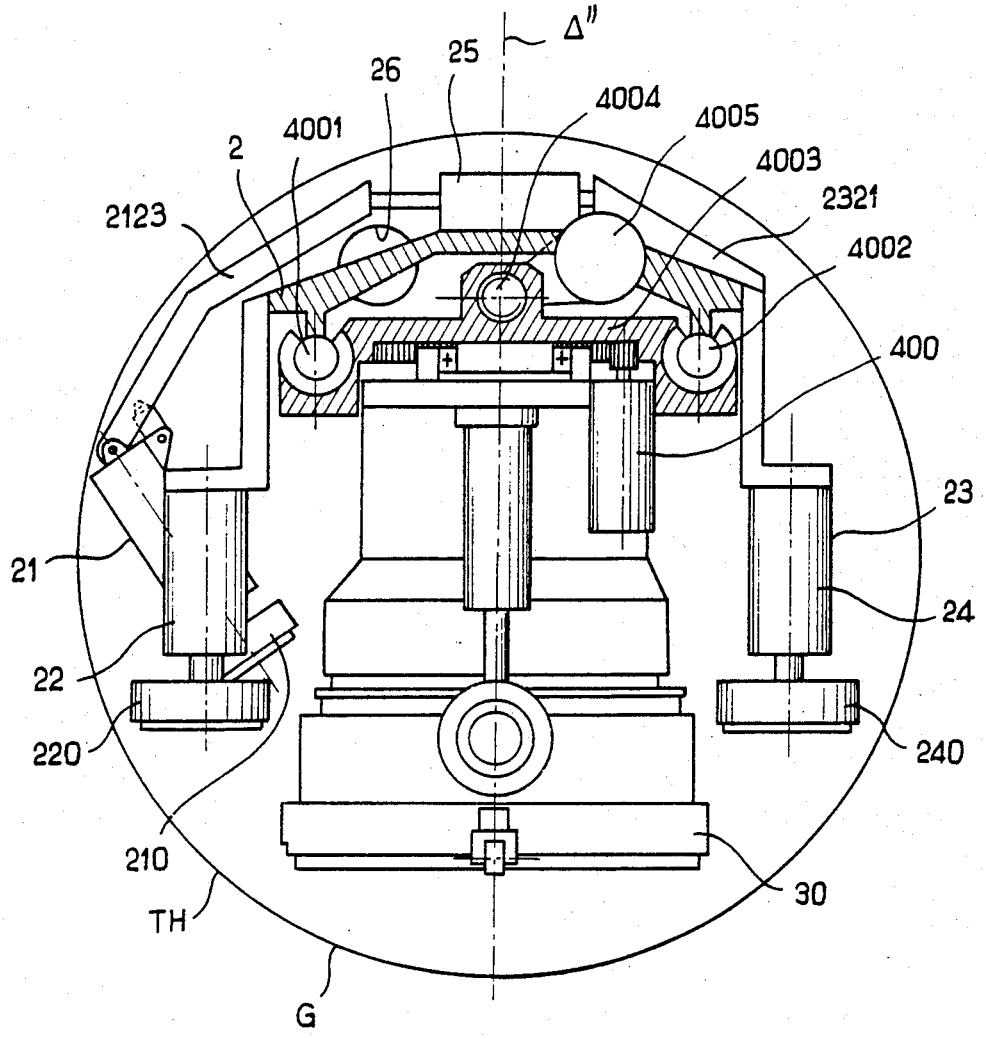
FIG. 7 shows a front view of one detailled embodiment of the arrangement of the vehicle on the second member forming a second arm in the embodiment of the system in accordance with the invention as shown in FIG. 5*a*.

There is shown in FIG. 7 a front view in partial cross-section of the member 2 forming an arm, as seen in a direction parallel to the axis δ' shown in FIG. 5*a*. In FIG. 7 a circle surrouding the member 2 forming an arm, equipped with its accessories, and representing the contour of the manhole is denoted G.

As shown in the aforementioned FIG. 7, the opposed actuators 21 and 23 form the previously mentioned mobile assembly and, to this end, they are mounted in such a way as to be further apart than the fixed pair of actuators 22, 24 in a direction perpendicular to the longitudinal axis Δ' of the second arm 2 and parallel to the partition plate PP. The aforementioned actuators 21 and 23 are mounted on and fastened to the piston rod of the actuator 25 through the intermediary of curved arms denoted 2123 and 2321. As will be noted in FIG. 7, one of the actuators constituting the mobile assembly, the actuator 21 for example, is retractable in order to enable retraction of the assembly into the protective jacket formed by the first arm 1, to enable the assembly to be inserted through the manhole TH. The retraction of the actuator 21 is shown in FIG. 7, the assembly constituted by the member 2 forming an arm and its accessories being inscribed within the circle G representing the contour of the manhole TH. As shown in FIG. 7, the accessories may advantageously comprise a motor denoted 400 for orienting the decontamination means 30, orientation of the decontamination means 30 being procured by rotation about the axis δ'' perpendicular to the longitudinal axis δ' of the member 2 forming an arm as previously mentioned. The accessories also comprise shafts 4001, 4002 for guiding the carriage carrying the decontamination means, the vehicle proper being denoted 4003 in this embodiment and consisting in a carriage sliding on the guide shafts 4001, 4002, a lead screw type drive screw denoted 4004 and a drive motor denoted 4005 for the lead screw.

The system in accordance with the invention as shown in FIG. 5*a* through 7 makes it possible in an advantageous way to decontaminate the partition plate PP of the water box of a steam generator.

One particularly advantageous embodiment of the system in accordance with the invention will now be described with reference to FIGS. 8*a* and 8*b*, this embodiment being more specifically adapted to decontaminating the internal wall of the bowl of the water box BAE of a nuclear power station steam generator.

Figure 8A:
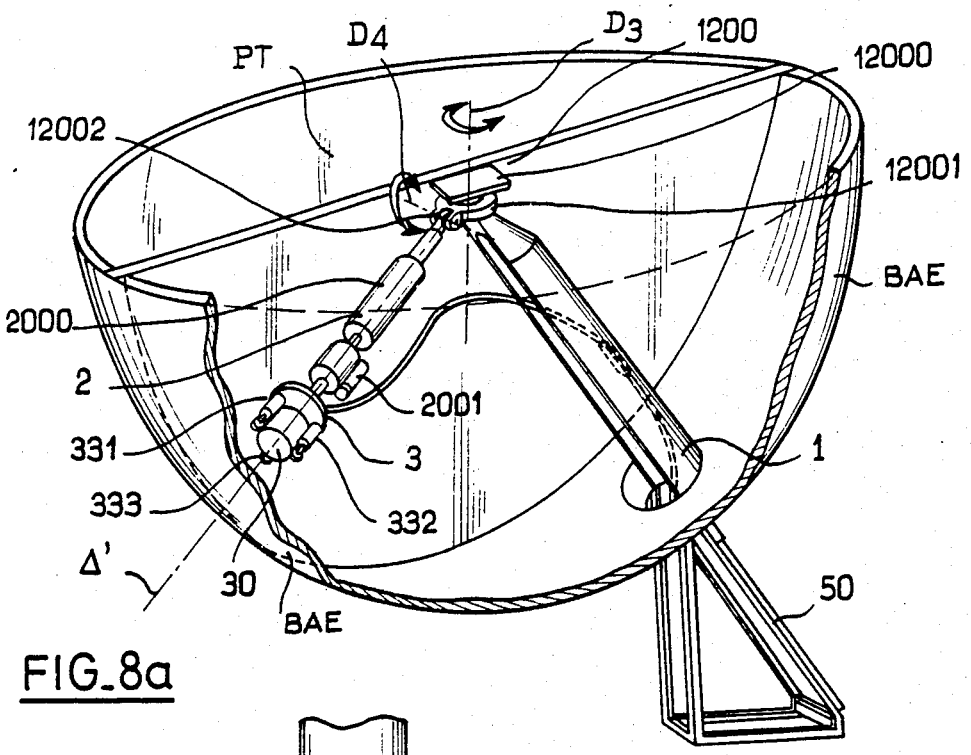
FIG. 8*a* shows a partially cut away perspective view of a system in accordance with the invention more specifically adapted for decontamination of the internal wall of the bowl of the water box of a nuclear power station steam generator.

In the embodiment as shown in FIG. 8*a* in particular, the second member 2 forming the second arm is articulated to the first arm 1 by a hinge the deployment plane of which can be oriented in rotation. In FIG. 8*a* the deployment plane of the orientable hinge denoted 1200 has been represented by the longitudinal axis δ' of the second arm denoted 2 and the orientation rotation axis denoted D3, i.e. the rotation axis of the hinge 1200. Deployment of the hinge, that is to say orientation of the longitudinal axis δ' of the arm forming the second arm 2 in the deployment plane constituted by the axes D3 and Δ' is then about an axis D4 orthogonal to the deployment plane of the hinge 1200.

According to one advantageous characteristic of the system in accordance with the invention, as shown in FIG. 8*a*, the deployment plane of the hinge 1200 constitutes in operation, the first member denoted 1 and the second member denoted 2 forming arms being in the deployed position, a diametral plane of the hemispherical bowl of the water box BAE of the steam generator.

As will be noted in FIG. 8*a*, the orientable hinge 1200 may advantageously comprise a bearing fixed at the end of the first arm 1. The bearing is fitted with a plate denoted 12000 through which it contacts the tube plate PT of the steam generator. The contact plate may advantageously be constituted by a material matching the profile of the tube plate or tubular plate or by a set of retractable fingers distributed across the contact plate or by tubes on the tubular plate and inserted into the latter in order to fix the assembly. These members are not shown in FIG. 8*a*, in order to avoid overcomplicating the drawing.

The orientable hinge 1200 further comprises a turntable denoted 12001 able to rotate freely about the bearing. The rotation axis of the turntable constitutes the orientation rotation axis D3 of the deployment plane of the orientable hinge 1200. The turntable 12001 comprises at its periphery an articulation denoted 12002 the axis D4 of which is orthogonal to the orientation rotation axis D3 of the hinge 1200 and thus forms the previously mentioned orientable hinge. The second member 2 forming an arm pivots about the articulation 12002, as shown in FIG. 8*a*.

In the embodiment of FIG. 8*a*, the vehicle 3 is mounted at the end of the second arm 2 through the intermediary of a pusher member denoted 2000 enabling the vehicle 3 to be pressed in operation against the internal wall of the hemispherical bowl of the water box BAE of the stream generator. The pusher member 2000 may be a hydraulic actuator, for example. The travel of the aforementioned hydraulic actuator advantageously makes it possible to compensate for variations in the radius of action of the combination constituted by the second member 2 forming an arm and the vehicle, these variations in the radius of action being due to slight offsetting of the center of rotation of the hinge 1200, on the rotation axis D3, relative to the axis of symmetry of the hemispherical bowl of the water box of the steam generator.

According to another advantageous characteristic of the embodiment of the system in accordance with the invention shown in FIG. 8*a*, the vehicle 3 is also mobile in rotation relative to the longitudinal axis of the second arm, through the intermediary of a motor-gearbox unit denoted 2001.

Thus when the actuator or pusher member 2000 is operated, the vehicle 3 is pressed against the internal wall of the hemispherical bowl of the water box of the steam generator. The vehicle 3 may then be moved, entraining with it the member 2 forming an arm of the system, by means of the displacement system disposed on the vehicle 3. The aforementioned displacement system consists in a plurality of motorized drive rollers, the motorized drive rollers being denoted 331, 332, 333 in FIG. 8*a*.

According to another advantageous characteristic, the motorized rollers 331, 332, 333 form a tripod system. The driving of each roller may advantageously be controlled independently of that of the others.

Figure 8B:
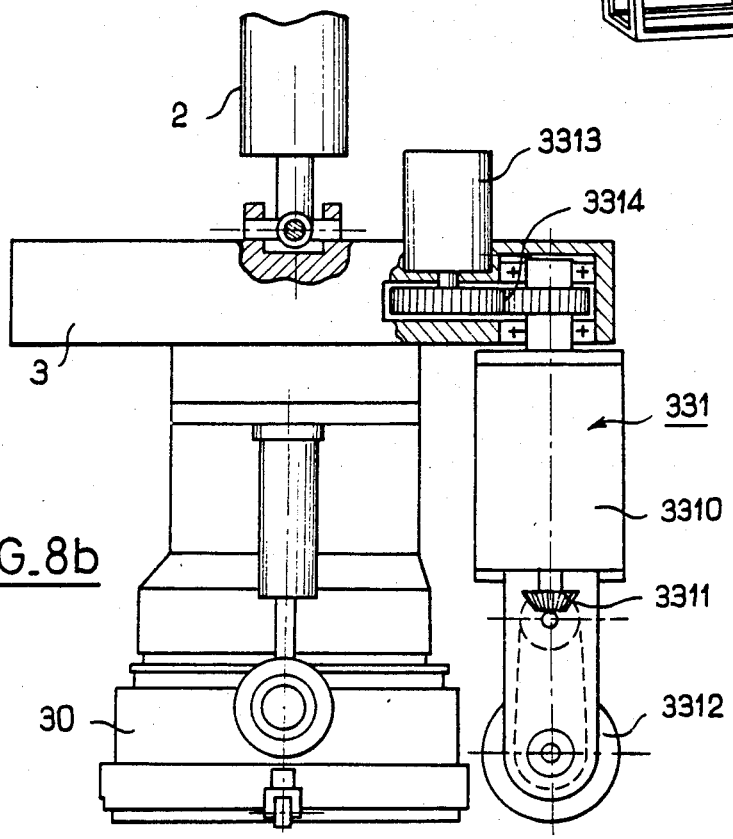
FIG. 8*b* shows a partial view of a detailled embodiment of the arrangement of the vehicle on the second member forming the second arm in the embodiment of the system in accordance with the invention shown in FIGS. 8*a* and 8*b*.

As shown in FIG. 8*b*, only one motorized roller being shown in this figure in order to avoid overcomplicating the drawing, each roller may advantageously comprise a drive motor denoted 3310 constituted by a motor-gearbox unit coupled to a chain and sprocket drive system 3311 for the drive wheel of the roller 3312. Also, and advantageously, each roller such as the roller 331 shown in FIG. 8*b* may be oriented by means of an orientation motor 3313 coupled by gearing 3314 to the shaft fastened to the body of the roller 331. The rollers forming the tripod system may advantageously be oriented simultaneously in the same direction, of course, and independent roller drive control can make it possible, where necessary, to control one or more rollers independently or all rollers together, in order to secure the displacement by traction of the combination constituted by the member 2 forming an arm and the vehicle 3.

A more detailled description of placing the system in accordance with the invention in position, in the embodiment thereof as shown in FIGS. 8*a* and 8*b*, will be given with reference to FIGS. 9*a*, 9*b*, 9*c*, 9*d* and 9*e*.

Figure 9A:
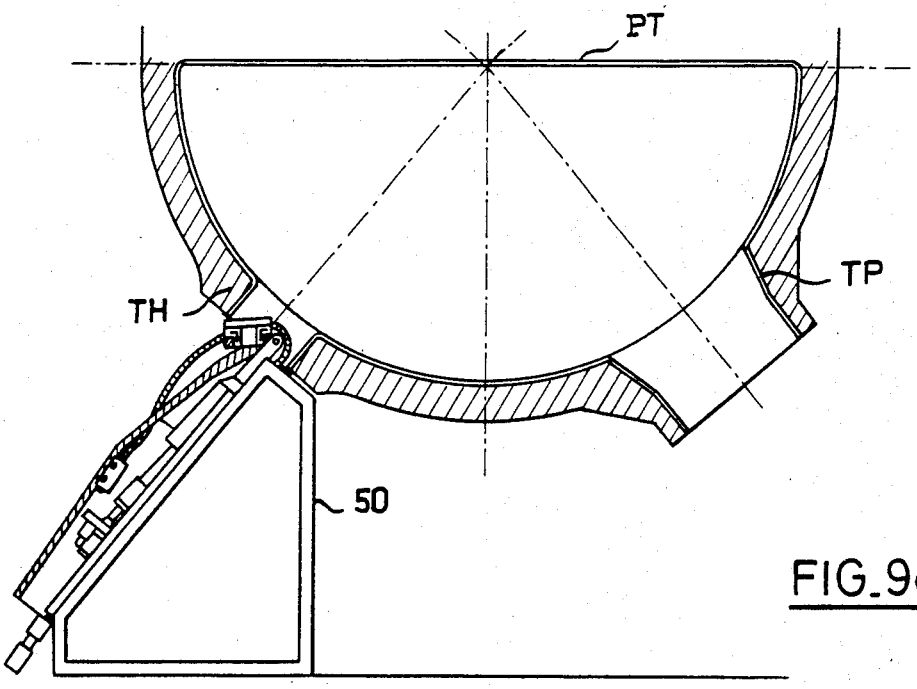
FIGS. 9*a* through 9*e* show stages in the installation of the system in accordance with the invention.
Figure 9B:
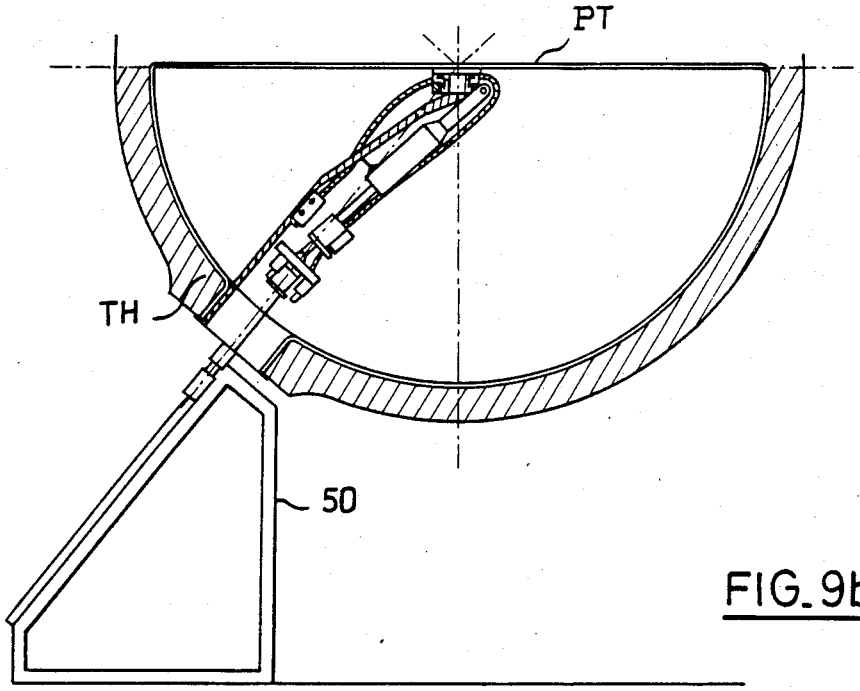

As will be noted in FIG. 9*a*, the system in accordance with the invention is positioned by means of a lift 50 as previously described. The system slides in translation over the inclined plane of the lift and the contact plate is brought into the vicinity of the tubular plate, in order to secure fixing to the latter. The system fixed in this way both to the tubular plate PT and to the flange of the manhole TH is shown in FIG. 9*b*. Placing of the bearing plate against the tubular plate is indicated, for example, by three proximity sensors disposed for this purpose on the bearing plate.

The system having been fixed to the flange of the manhole TH by locking the locknut provided for this purpose, the member 2 forming an arm is then deployed and the vehicle 3 is then lowered onto the bottom of the bowl of the water box BAE of the steam generator. Appropriate thrust is applied to the vehicle by the thrust actuator 2000 to secure good adhesion of the rollers onto the internal wall of the bowl of the steam generator. The corresponding position is as shown in FIG. 9*c*.

The rollers are then driven to procure the displacements needed to carry out the decontamination work by means of the decontamination means 30 carried by the vehicle 3 and to change sector so as to pass from a decontaminated to a non-decontaminated area to which the decontamination process is to be applied.

Figure 9C:
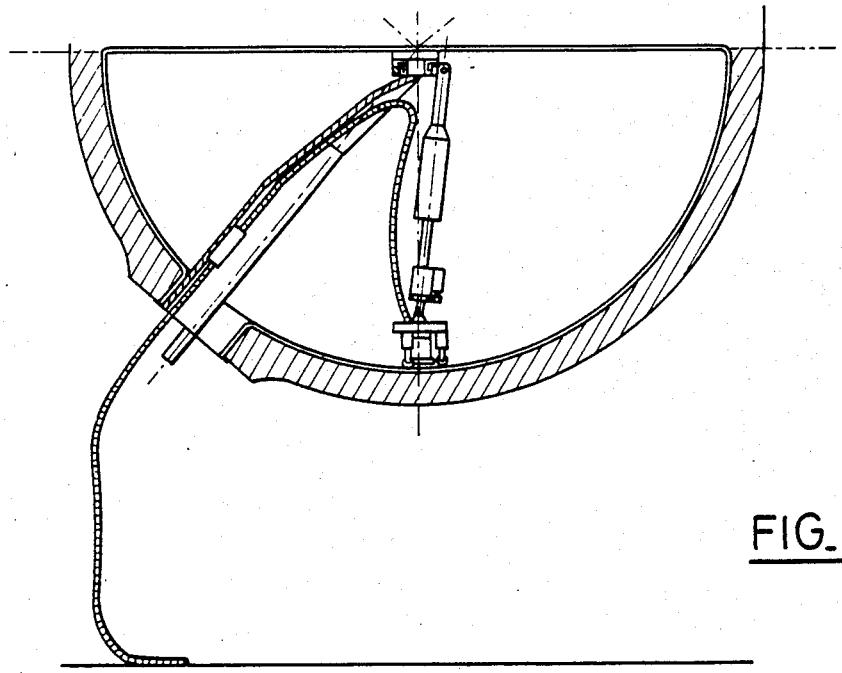

On completion of the decontamination process the system in accordance with the invention may be extracted by returning to a vertical position as shown in FIG. 9*c* the member 2 forming an arm, and folding the member 2 forming an arm, the vehicle having been moved by the thrust member 2000 to its position farthest away from the internal wall of the bowl of the steam generator. The folding of the arm 2 into the member 1 forming an arm may be effected by reeling in a cable, for example, or by any other appropriate means. The system in accordance with the invention may then be returned to the lift as previously described.

Figure 9D:
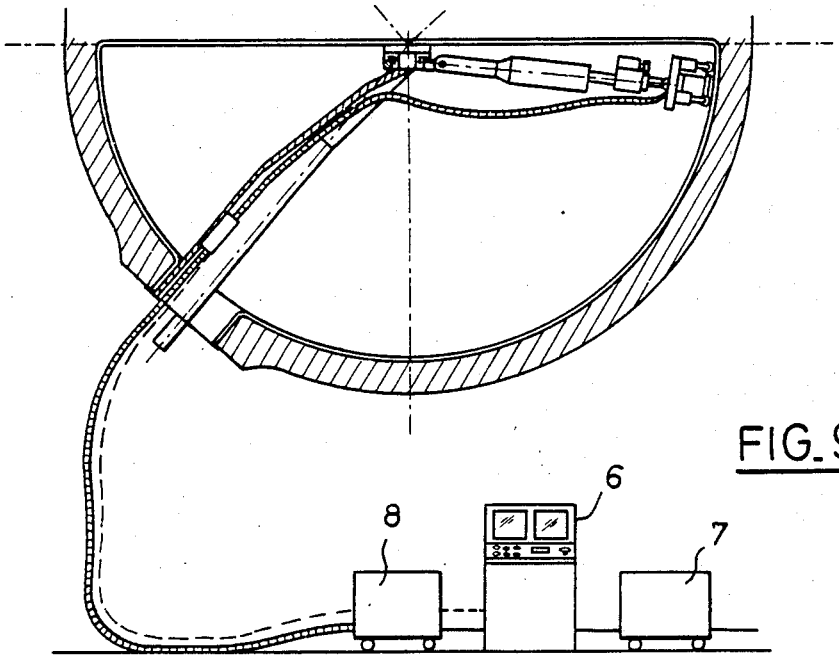
Figure 9E:
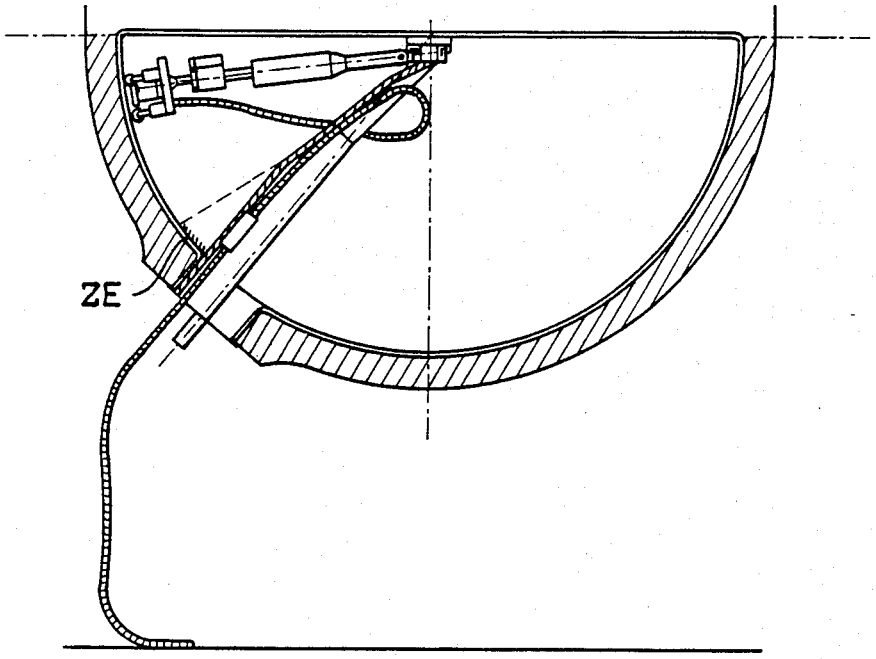

FIGS. 9*d* and 9*e* provide a better understanding of the principle of tracking the arm 2 as it moves inside the hemispherical bowl of the water box BAE of the steam generator.

As the vehicle 3 moves, through the intermediary of the actuator 2000 the thruster arm 20 presses the vehicle 3 against the spherical surface of the water box and tracks the movement of the vehicle 3 by virtue of the two degrees of freedom provided at the articulation 1200.

The rotation axis D3 enables the member 2 forming an arm to move round the structure, as shown in FIG. 9*e* in particular. This system advantageously makes it possible to move the vehicle around the manhole as will be readily understood on referring to FIG. 9*e*, only a substantially circular area denoted ZE being out of reach of the vehicle and the decontamination means 30.

The interface between the thruster arm 20 and the vehicle 3 is constituted by a motor-gearbox unit combination enabling orientation of the decontamination means 30 in order to conform to the feed and take-off directions for the decontamination fluid. The member 2 forming an arm may then advantageously be coupled to the vehicle 3 by means of a universal joint type ball-joint. This type of connection makes it possible to transmit orientation control to the vehicle 3 whilst guaranteeing transmission of the force from the thruster arm 20 and application of the vehicle 3 onto the surface to be decontaminated.

In the event of failure of the supply fluids, the thruster arm 20 continues to fulfil its thruster function and holds the vehicle 3 in position. This is enabled in particular by the reduced radius of action of the thruster arm 20 from the top towards the bottom of the water box of the steam generator.

Finally, the top plate 12001 of the hinge 1200 may be oriented mechanically from outside the water box BAE of the steam generator in order to reposition the member 2 forming an arm and the vehicle 3 on the folding axis of the member 2 forming an arm in the event of a major fault.

A more detailled description of the control means 6 shown in FIG. 1*a* in particular will now be given with reference to FIGS. 10*a*, 10*b* and 10*c*.

Figure 10A:
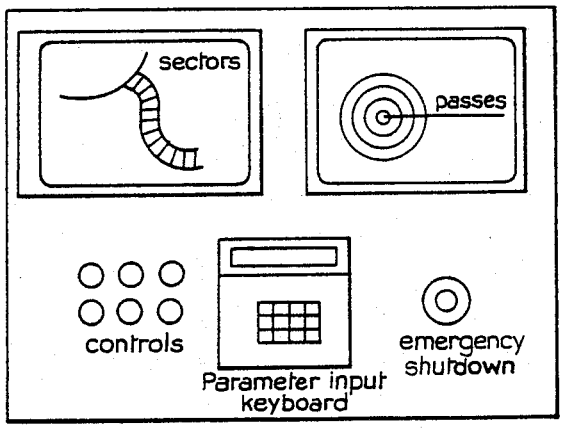
FIGS. 10*a*, 10*b* and 10*c* show diagrams representing control devices and their use in conjunction with a decontamination system in accordance with the invention as shown in FIGS. 1*a*, 5*a* and 8*a*, respectively.

As shown in FIG. 10*a* in particular, in the case of decontaminating the primary pipework of the water box of a nuclear power station steam generator the control means 6 comprise a control console carrying the vehicle displacement controls, two screens for viewing the work and the safety devices. As shown in FIG. 10*a*, the two screens advantageously make it possible to display sectors of the primary pipework TP to be decontaminated and an analog representation of the decontamination passes to be carried out for each sector.

Figure 10B:
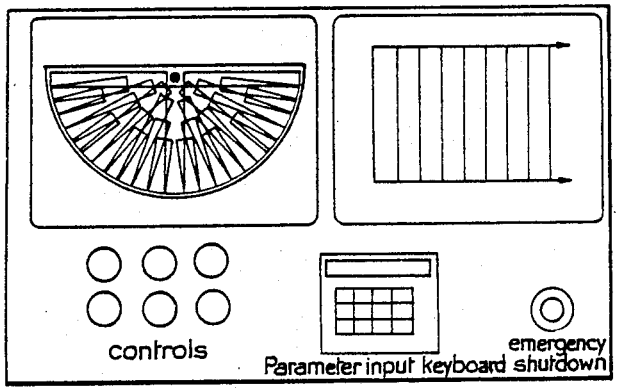
Figure 10C:
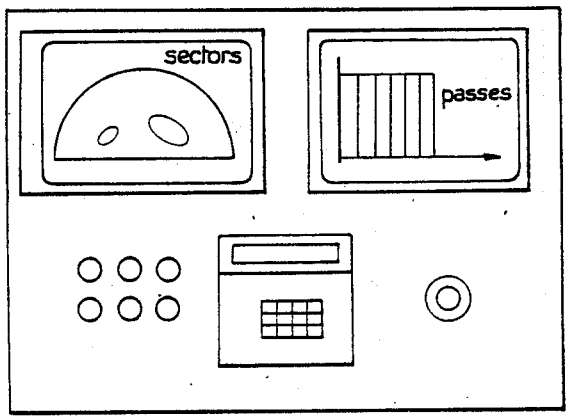

In the case where the system in accordance with the invention is more particularly adapted to decontaminating the partition plate PP of the water box of the steam generator, the system is controlled by an operator using on the control console of the control means 6 controls for the elementary movements of rotation of the decontamination means 30, operative displacement of the vehicle 3 and pendular displacement of the arm 2, as shown in FIG. 10*b*. The various movement axes are instrumented in order to provide on the previously mentioned dual screen console on the one hand an image of the partition plate with the strips already decontaminated and the strips remaining to be decontaminated and, on the other hand, an image of the strip being decontaminated with a display indicating the passes done.

In the case where the system in accordance with the invention is more particularly adapted to decontaminating the bowl of the water box BAE of the steam generator, the system is controlled by an operator using on the control console of the control means 6 controls for such elementary movements as the displacement and orientation of the drive rollers and the orientation of the vehicle, together with emergency shutdown controls. A viewing system mounted on a turret fixed to the member 2 forming an arm serves to track the vehicle 3 as it moves.

For decontaminating different parts such as the primary pipework TP of the water box of a steam generator, the partition plate PP of the same water box and the hemispherical bowl of the latter, the system in accordance with the invention may advantageously be adapted to carry out decontamination by electrodecontamination. In this case, as will be described in detail hereinafter in the description, decontamination may be effected by electrodecontamination from outside the water box of the steam generator.

Figure 11A:
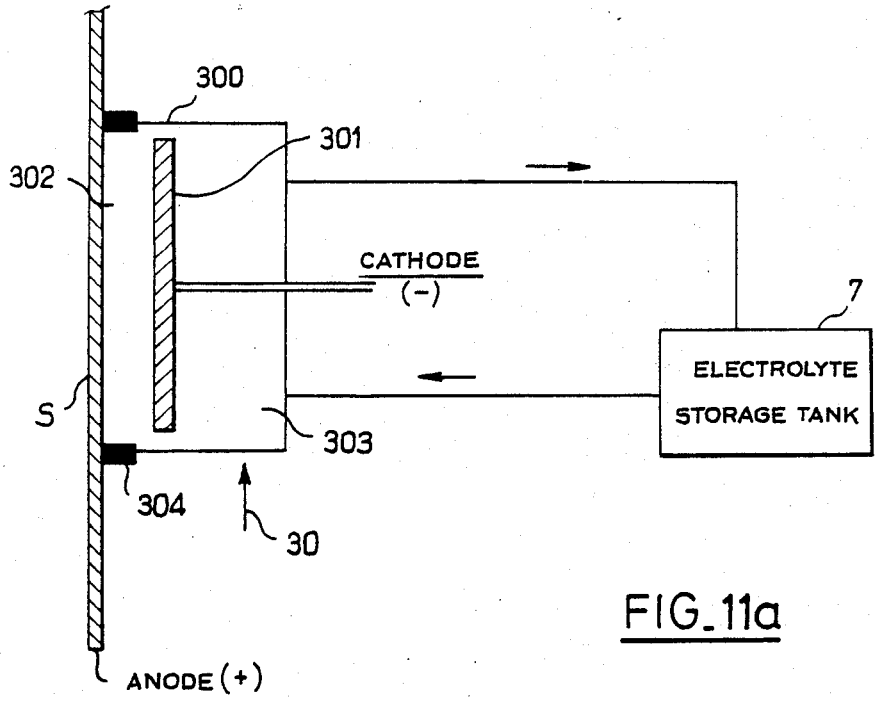
FIGS. 11*a* and 11*b* respectively show a theoretical circuit diagram representative of the decontamination means in the case where these decontamination means consist of an electropolishing cell and a detailled diagram in partial cross-section of one advantageous embodiment of a cell of this kind.

In the case where decontamination is effected by electrodecontamination, the decontamination means 30 may advantageously comprise an electropolishing cell as shown in FIG. 11*a*.

A more detailled description of an electropolishing cell particularly suited to the decontamination system in accordance with the invention will be given with reference to FIGS. 11*a* and 11*b*.

In FIG. 11*a* there is schematically represented an electropolishing cell denoted 30 which comprises a sucker formed by a sucker body 300 which is substantially a body of revolution. A permeable electrode denoted 301 is situated inside the sucker body 300 and delimits within the latter when the sucker body is applied to the wall of the surface to be treated an electrolyte inlet chamber denoted 302 and an electrolyte suction chamber denoted 303. A gasket denoted 304 is placed at the periphery of the sucker body 300. The electrolyte contained in an electrolyte storage tank constituted by the decontaminating fluid tank denoted 8 in FIG. 1*a* in particular circulates through the cathode 301 which is pierced by small-diameter holes, the combination constituted by the sucker body and the cathode moving along the wall and the electropolishing cell being sealed by the previously mentioned gasket 304.

Figure 11B:
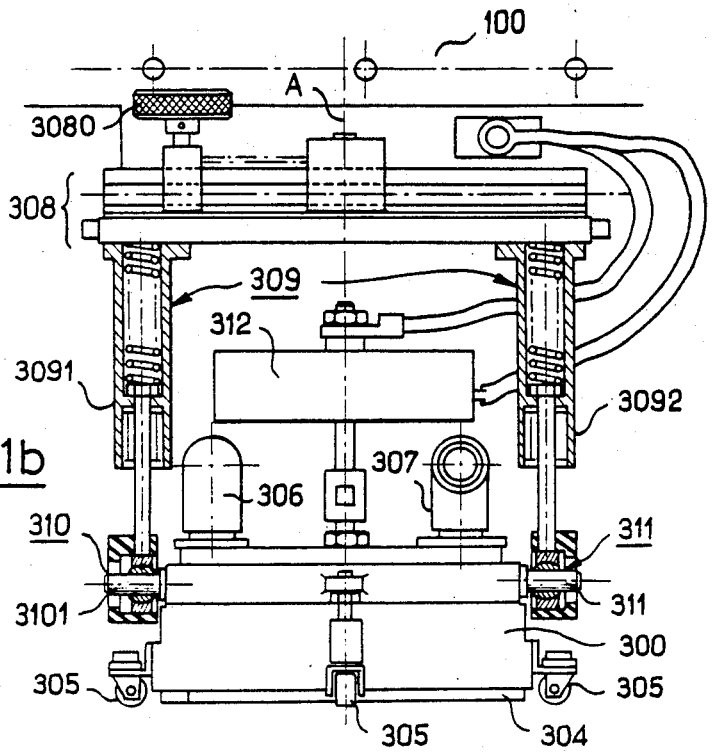

As further shown in FIG. 11*b*, a set of rollers 305 is fastened to the sucker body 300, the rollers being adapted to support the sucker on the surface S in order to maintain a constant distance between the electrode 301 and the surface S to be treated. As a result of the depressurization resulting from sucking out of the electrolyte, the gasket 304 is normally crushed. To control this crushing, the aforementioned set of rollers, constituted by polytetrafluorethylene rollers, for example, is mounted on ball bearings with pivotting shafts fixed to the body of the sucker. The function of this set of rollers is to procure and facilitate sliding of the sucker over the surface S and to prevent the phenomenon of chattering which occurs when the gasket 304 is crushed to an excessive degree.

According to one advantageous characteristic of the electropolishing cell in accordance with the invention, the inlet chamber 302 and the suction chamber 303 respectively comprise an inlet nozzle 306 and a suction nozzle 307 for the previously mentioned electrolyte. According to another particularly advantageous aspect of the electropolishing cell in accordance with the present invention, the electropolishing sucker is fastened to the vehicle 3 through the intermediary of an indexing table 308 mounted to be rotatable about an axis A perpendicular to the direction formed by the electrolyte inlet nozzle 306 and the electrolyte suction nozzle 307. The indexing table 308 is provided with adjustment means 3080 serving to maintain substantially vertical during displacement of the vehicle 3 the plane containing the axis of the electrolyte inlet and suction nozzles denoted 306, 307. Of course, for a given trajectory, the orientation of the aforementioned plane may be adjusted once and for all. In particular, where the surface to be treated is constituted by a spherical surface, especially in the case of decontamination of the bowl of the water box BAE of the steam generator, the displacement trajectory of the vehicle may be constituted by a great circle of the sphere, for example, and the orientation of the plane may thus be established for a given trajectory. The aforementioned adjustment means 3080 can then be constituted by a stepper motor fastened to the indexing table and serving to adjust the distance of the latter according to the trajectory chosen.

According to another advantageous characteristic of the electropolishing cell in accordance with the present invention, the sucker body 300 is fastened to the indexing table 308 through the intermediary of a spring suspension 309.

In an advantageous embodiment of the aforementioned spring suspension, the latter comprises at least two spring type piston-and-cylinder actuators denoted 3091, 3092 in FIG. 11*b*, the piston rod of which is fastened to the sucker body 300 through the intermediary of a ball-joint articulation denoted 3100, 3110. The aforementioned ball-joint articulation 3100, 3110 is mounted on two fixing lugs 3101, 3111 fastened to the sucker body 300 and disposed on a diameter of the latter. As will be noted in FIG. 11*b* in particular, each ball-joint 3100, 3110 is mounted to slide along the aforementioned diameter. The spring-type actuators 3091, 3092 are fixed onto the indexing table or plate and are arranged in such a way that the force exerted by the springs of the actuators or application force ensures permanent contact between the sucker and the wall to be treated. The aforementioned actuators make it possible to compensate for any variations in the level of the wall by enabling to and fro movement along the previously described axis A. The coupling of the actuators to the sucker body 300 by sliding ball-joints 3100, 3110 enables the sucker to assume any angular position without inducing any bending stresses in the piston rods or in the previously described fixing lugs 3101, 3111. When the electropolishing sucker is mounted on the vehicle in accordance with the invention two flanges fixed to the body of the actuators 3091, 3092 serve to compress the latter, holding the sucker body and the sucker in a raised position.

Because the sucker is rotated to apply angular corrections, it is advantageous to connect the electrode 301 electrically by means of a slip-ring system. The latter is advantageously mounted on the electrode rod and is denoted 312. The slip-ring system may advantageously comprise a brush type system and it may comprise a cooling circuit using circulation of air to limit overheating of the slip-ring system. The sucker body 300 may advantageously be made from a synthetic material such as hydrogentated polypropylene (PPH) or difluorinated polyvinyl (PVDH).

There has therefore been described a system for working on the primary pipework, the partition plate and the walls of the bowl of the water box of a steam generator which is particularly advantageous in that the system, by virtue of inherent design features, can be used to decontaminate all the parts previously mentioned.

Of course, the system in accordance with the invention is particularly well suited to decontamination by electrodecontamination, as previously described in the description.

In particular, each type of member 2 forming an arm may be directly associated, according to the area of the steam generator water box to be decontaminated, with a corresponding articulation 12, 120 or 1200, this articulation being fixable to an arm or member 1 forming a universal arm adapted to receive the corresponding articulation. Thus the various members 2 forming arms constitute a set of arms adapted to be fitted to the member 1 forming a unique arm.

Of course, the various forms of vehicle are then associated with the corresponding member 2 forming an arm.

Of course, in the case where decontamination is effected by electrodecontamination, the electrical power supply means 7 are advantageously constituted by a battery of controlled rectifiers in order to enable supply of electrical power to the vehicle and, in particular to the previously described electrodecontamination means.

I claim:

1. A system for working on a primary pipework and on a water box having a manhole for accessing the interior confines of the primary pipework of nuclear power station steam generators, said system comprising:

a removable vehicle mechanically fastened to a tensioner cable travelling, during displacement of the removable vehicle in the primary pipework, over direction-changing pulleys, the tensioner cable being paid out from a balancer winder situated in the vicinity of the free end of an insertable member outside the manhole when said insertable member is in position, said insertable member being comprised of a first member and a second member, said first member having a substantially elongate shape and forming a first arm of the system, said second member having a substantially elongate shape, articulated at one end to an end of the first member, said second member forming a second arm of the system, and the combination of the first and second arms being adapted to be inserted into the water box of the steam generator through the manhole in said water box and said second member being adapted to be placed in a deployed position relative to the first member, said vehicle mounted on said second arm and being mobile relative to it, working means carried by said vehicle, said working means being, by virtue of its mobility relative to said second arm and its relative angular displacement between the first and second arms, capable of reaching and engaging by sliding along in contact with the surfaces of the internal area of the steam generator to effect decontamination of said surfaces by said contact with said working means, and remote control means for the vehicle and the work means.

2. A system according to claim 1, wherein said first member is a hollow member of substantially semi-cylindrical shape so as to form a protective jacket for said second member when the latter is in a non-deployed position.

3. A system according to claim 1, wherein to provide for working on the primary pipework of a steam generator, said second member forming the second arm is constituted by a telescopic arm, and said vehicle being removably mounted at the end of the latter.

4. A system according to claim 3, wherein said vehicle is mechanically fastened to a tensioner cable travelling, during displacement of the removable vehicle in the primary pipework, over pulleys at the end of the second arm and pulleys articulating together the first and second arms, the tensioner cable being paid out from a balancer winder situated in the vicinity of the free end of the first member outside the manhole when said member is in position.

5. A system according to claim 1, wherein said vehicle comprises:

a vehicle body constituted by a longitudinal member disposed along the longitudinal axis of the vehicle, a chassis mounted to rotate on the longitudinal member forming the vehicle body, said chassis comprising a plate adapted to support said working means, and support means for said vehicle constituted by first and second sets of actuators, each set of actuators fastened to the body having in a plane orthogonal to the longitudinal axis of the vehicle a tripod configuration.

6. A system according to claim 5, wherein said chassis is mounted to be rotated on the longitudinal member by means of a toothed ring and a motor.

7. A system according to claim 5, wherein the working means are constituted by decontamination means and are supported by the plate through the intermediary of actuators each of which being fixed by a ball-joint articulation to the decontamination means, radial translation of the plate relative to the longitudinal axis of the vehicle body being controlled by a motor fastened to the decontamination means in order to enable the decontamination means to be applied to the wall of the primary pipework.

8. A system according to claim 5 wherein a first and a second set of actuators are mounted on seating plates the orientation of which seating plates taken relative to a plane orthogonal to the longitudinal axis of the vehicle body being adaptable to be adjusted to a specific angular value through the intermediary of ball-joint fixings, one of the seating plates being mobile in translation in a direction parallel to the longitudinal axis of the vehicle through the intermediary of traction actuators to procure stepwise displacement of the vehicle as a whole in this direction.

9. A system according to claim 1 wherein said water box has a partition plate and to provide for work such as decontamination of the partition plate of the water box of a steam generator said second member forming the second arm is articulated to said first arm by a universal joint type articulation, said articulation comprising, in the operative position, a first axis substantially parallel to the partition plate and a second axis substantially perpendicular to the partition plate, said vehicle being mounted to be mobile in translation along said second arm.

10. System according to claim 9, wherein to provide for holding said second arm on and moving it over the partition plate said second arm comprises:

a central first actuator being disposed in the vicinity of the articulation and being provided with a fixing sucker, said first central actuator serving to fix the combination constituted by the first and second arms in translation in the direction perpendicular to the partition plate, and a plurality of actuators disposed at the free end of the second arm, at least two opposed actuators forming an assembly mobile relative to said second arm being displaceable perpendicularly to the longitudinal direction of the second arm in a direction parallel to the partition plate to procure the corresponding displacement of said second arm, the axis perpendicular to the partition plate forming an axis of rotation, relative to the fixed point formed by the central actuator, the plurality of actuators having piston rods and being provided at the end of the piston rods with a sucker adapted to be fixed by depressurization.

11. A system according to claim 10, wherein the at least two opposed actuators forming the assembly mobile relative to said second arm are rendered mobile by means of a double-acting actuator the body of which is spring-mounted on said second arm and resiliently urged towards an intermediate position.

12. A system according to claim 11, wherein a safety actuator directed towards the longitudinal axis of said second arm is further provided at the end thereof, said safety actuator directed towards the longitudinal axis of said second arm is further provided at the end thereof, said safety actuator sensing to lock said second arm in its current position in the case of any failure of supply.

13. A system according to claim 10, wherein said plurality of actuators includes a pair fixed relative to said second arm and said opposed actuators forming the mobile assembly are mounted at a distance apart greater than that of the pair of fixed actuators in a direction perpendicular to the longitudinal axis of the second arm and parallel to the partition plate, one of said actuators constituting the mobile assembly being retractable to enable the assembly to be retracted into the protective jacket formed by the first arm in order to enable insertion of the assembly through the manhole.

14. A system according to claim 1, wherein to provide for work such as decontamination of the internal walls of the spherical bowl of the water box of said steam generator said second element forming the second arm is articulated relative to said first arm through a hinge the deployment plane of which can be oriented in rotation, said plane formed by the longitudinal axis of the second arm and the orientation rotation axis constituting in operation a diametrical plane of the hemispherical bowl.

15. A system according to claim 14, wherein said orientable hinge comprises:

a bearing fixed to the end of the first arm fitted with a plate adapted to contact a tube plate of the steam generator, a turntable freely rotatable about the bearing and the rotation axis of which constitutes the orientation rotation axis of said deployment plane of the orientable hinge, said turntable comprising at its periphery an articulation with its axis orthogonal to the orientation rotation axis and forming an orientable hinge, said second arm pivoting about said articulation formed on said periphery of said turntable.

16. A system according to claim 14 wherein said vehicle is mounted at the end of said second arm by a thruster member enabling said vehicle to be applied in operation against the internal wall of the hemispherical bowl of the water box of the steam generator.

17. A system according to claim 17, wherein said vehicle is also rotatable relative to the longitudinal axis of said second arm by a motor-gearbox unit.

18. A system according to claim 17, wherein said vehicle is provided with a displacement system comprising a plurality of motorized drive rollers.

19. A system according to claim 18, wherein said rollers form a tripod system, the driving action of each roller being controllable independently of the others.

20. A system according to claim 1, wherein said steam generator has a tube plate and to provide for insertion and positioning in the manhole of the combination consisting of the first and second arms said system further comprises a lift system of the inclined plane type, the inclination angle of the inclined plane enabling by translation of said combination the positioning of the articulation between the first and second arms in the vicinity of the center of the tube plate of the steam generator.

21. A system according to claim 1, wherein said working means comprise an electropolishing cell.

22. A system according to claim 21, wherein said cell comprises:

a sucker formed by a sucker body which is substantially a body of revolution, a permeable electrode situated in the sucker body and delimiting within the latter when the sucker body is applied against the wall of the surface to be treated an electrolyte inlet chamber and an electrolyte suction chamber, a gasket disposed at the periphery of the sucker body, and a set of rollers fastened to the sucker body, said rollers being adapted to support said sucker on said surface in order to maintain a constant distance between the electrode and the surface to be treated.

23. A system for working on a primary pipework and on a water box having a manhole for accessing the interior confines of the primary pipework of nuclear power station steam generators, comprising:

a removable vehicle mechanically fastened to a tensioner cable travelling, during displacement of the removable vehicle in the primary pipework, over direction-changing pulleys, the tensioner cable being paid our from a balancer winder situated in the vicinity of the free end of an insertable member outside the manhole when said insertable member is in position, said insertable member being comprised of a first member and a second member, said first member having a substantially elongated shape and forming a first arm of the system, said second member having a substantially elongate shape, articulated at one end to an end of the first member, said second member forming a second arm of the system, and the combination of the first and second arms being adapted to be inserted into the water box of the steam generator through the manhole and said second member being adapted to be placed in a deployed position relative to the first member, said vehicle mounted on said second arm and being mobile relative to it, working means carried by said vehicle, the working means being, by virtue of its movement relative to said second arm and its relative angular displacement between the first and second arms, adapted to reach a plurality of areas of the internal surface of the steam generator, and said vehicle and said working means having remote control means;

said vehicle having a vehicle body constituted by a longitudinal member disposed along the longitudinal axis of the vehicle, a chassis mounted to rotate on the longitudinal member forming the vehicle body, said chassis comprising a plate adapted to support said working means, and support means for said vehicle constituted by first and second sets of actuators, each set of actuators fastened to the body having in a plane orthogonal to the longitudinal axis of the vehicle a tripod configuration.

24. A system for working on a primary pipework and on a water box having a manhole for accessing the interior confines of the primary pipework of nuclear power station steam generators, comprising:

a removable vehicle mechanically fastened to a tensioner cable travelling, during displacement of the removable vehicle in the primary pipework, over direction-changing pulleys, the tensioner cable being paid out from a balancer winder situated in the vicinity of the free end of an insertable member outside the manhole when said insertable member is in position, said insertable member being comprised of a first member and a second member, said first member having a substantially elongate shape and forming a first arm of the system, said second member having a substantially elongate shape, articulated at one end to an end of the first member, said second member forming a second arm of the system, and the combination of the first and second arms being adapted to be inserted into the water box of the steam generator through the manhole and said second member being adapted to be placed in a deployed position relative to the first member, said vehicle mounted on said second arm and being mobile relative to it, working means carried by said vehicle, the working means being, by virtue of its movement relative to said second arm and its relative angular displacement between the first and second arms, adapted to reach a plurality of areas of the internal surface of the steam generator, remote control means for the vehicle and the work means, said water box has a partition plate and to provide for work such as decontamination of the partition plate of the water box of the steam generator, said second member forming said second arm is articulated to the first arm by a universal joint type articulation, said articulation comprising, in the operative position, a first axis substantially parallel to the partition plate and a second axis substantially perpendicular to the partition plate, said vehicle being mounted to be mobile in translation along said second arm, and wherein to provide for holding said second arm on and moving it over the partition plate said second arm comprises a central first actuator being disposed in the vicinity of the articulation and being provided with a fixing sucker, said first central actuator serving to fix the combination constituted by the first and second arms in translation in the direction perpendicular to the partition plate, and a plurality of actuators disposed at the free end of the second arm, at least two opposed actuators forming an assembly mobile relative to said second arm being displaceable perpendicularly to the longitudinal direction of the second arm in a direction parallel to the partition plate to procure the corresponding displacement of said second arm, the axis perpendicular to the partition plate forming an axis of rotation, relative to the fixed point formed by the central actuator, the plurality of actuators having piston rods and being provided at the end of the piston rods with a sucker adapted to be fixed by depressurization.

* * * * *